US007269559B2

(12) United States Patent
Kondo et al.

(10) Patent No.: US 7,269,559 B2
(45) Date of Patent: Sep. 11, 2007

(54) SPEECH DECODING APPARATUS AND METHOD USING PREDICTION AND CLASS TAPS

(75) Inventors: Tetsujiro Kondo, Tokyo (JP); Hiroto Kimura, Tokyo (JP); Tsutomu Watanabe, Kanagawa (JP); Masaaki Hattori, Chiba (JP)

(73) Assignee: Sony Corporation (JP)

( * ) Notice: Subject to any disclaimer, the term of this patent is extended or adjusted under 35 U.S.C. 154(b) by 810 days.

(21) Appl. No.: 10/239,135

(22) PCT Filed: Jan. 24, 2002

(86) PCT No.: PCT/JP02/00491

§ 371 (c)(1),
(2), (4) Date: Mar. 30, 2003

(87) PCT Pub. No.: WO02/059877

PCT Pub. Date: Aug. 1, 2002

(65) Prior Publication Data

US 2003/0163317 A1 Aug. 28, 2003

(30) Foreign Application Priority Data

Jan. 25, 2001 (JP) ..... P2001-016870

(51) Int. Cl.
*G10L 13/02* (2006.01)

(52) U.S. Cl. ..... 704/262; 704/264

(58) Field of Classification Search ..... 704/262, 704/264

See application file for complete search history.

(56) References Cited

U.S. PATENT DOCUMENTS 4,776,014 A * 10/1988 Zinser, Jr. ..... 704/262
4,980,916 A * 12/1990 Zinser ..... 704/207
5,305,332 A 4/1994 Ozawa
5,359,696 A 10/1994 Gerson et al.
5,361,323 A 11/1994 Murata et al.

(Continued)

FOREIGN PATENT DOCUMENTS

EP 0 532 225 A2 3/1993

(Continued)

*Primary Examiner*—Michael N Opsasnick
(74) *Attorney, Agent, or Firm*—Lerner, David, Littenberg, Krumholz & Mentlik, LLP

(57) ABSTRACT

The present invention relates to a data processing apparatus capable of obtaining high-quality sound, etc. A tap generation section 121 generate a prediction tap from synthesized speech data for 40 samples in a subframe of subject data of interest within the synthesized speech data such that speech coded data coded by a CELP method, and synthesized speech data in which a position in the past from a subject subframe by a lag indicated by an L code located in that subject subframe is a starting point. Then, a prediction section 125 decodes high-quality sound data by performing a predetermined prediction computation by using the prediction tap and a tap coefficient stored in a coefficient memory 124. The present invention can be applied to mobile phones for transmitting and receiving speech.

8 Claims, 23 Drawing Sheets

U.S. PATENT DOCUMENTS

| | | | | | |
|---|---|---|---|---|---|
| 5,450,449 | A | * | 9/1995 | Kroon | 375/350 |
| 5,634,085 | A | | 5/1997 | Yoshikawa et al. | |
| 5,651,091 | A | * | 7/1997 | Chen | 704/207 |
| 5,692,101 | A | * | 11/1997 | Gerson et al. | 704/222 |
| 5,708,757 | A | * | 1/1998 | Massaloux | 704/220 |
| 5,826,224 | A | * | 10/1998 | Gerson et al. | 704/222 |
| 5,884,010 | A | * | 3/1999 | Chen et al. | 704/228 |
| 6,014,618 | A | * | 1/2000 | Patel et al. | 704/207 |
| 6,067,511 | A | * | 5/2000 | Grabb et al. | 704/223 |
| 6,119,082 | A | * | 9/2000 | Zinser et al. | 704/223 |
| 6,243,673 | B1 | * | 6/2001 | Ohno | 704/207 |
| 6,393,390 | B1 | * | 5/2002 | Patel et al. | 704/207 |
| 6,510,407 | B1 | * | 1/2003 | Wang | 704/207 |
| 6,865,530 | B2 | * | 3/2005 | Patel et al. | 704/223 |
| 2001/0000190 | A1 | | 4/2001 | Oshikiri et al. | |

FOREIGN PATENT DOCUMENTS

| | | | |
|---|---|---|---|
| EP | 0 602 826 | A2 | 6/1994 |
| EP | 1 308 927 | A1 | 5/2003 |
| JP | 63-214032 | A1 | 9/1988 |
| JP | 1-205199 | A1 | 8/1989 |
| JP | 4-30200 | A1 | 2/1992 |
| JP | 4-502675 | A1 | 5/1992 |
| JP | 4-212999 | A1 | 8/1992 |
| JP | 4-213000 | A1 | 8/1992 |
| JP | 6-131000 | A1 | 5/1994 |
| JP | 6-214600 | A1 | 8/1994 |
| JP | 7-50586 | A1 | 2/1995 |
| JP | 11-3098 | A1 | 1/1999 |

* cited by examiner

SPEECH DECODING APPARATUS AND METHOD USING PREDICTION AND CLASS TAPS

TECHNICAL FIELD

The present invention relates to a data processing apparatus. More particularly, the present invention relates to a data processing apparatus capable of decoding speech which is coded by, for example, a CELP (Code Excited Linear coding) method into high-quality speech.

BACKGROUND ART

FIGS. 1 and 2 show the configuration of an example of a conventional mobile phone.

In this mobile phone, a transmission process of coding speech into a predetermined code by a CELP method and transmitting the codes, and a receiving process of receiving codes transmitted from other mobile phones and decoding the codes into speech are performed. FIG. 1 shows a transmission section for performing the transmission process, and FIG. 2 shows a receiving section for performing the receiving process.

In the transmission section shown in FIG. 1, speech produced from a user is input to a microphone 1, whereby the speech is converted into an speech signal as an electrical signal, and the signal is supplied to an A/D (Analog/Digital) conversion section 2. The A/D conversion section 2 samples an analog speech signal from the microphone 1, for example, at a sampling frequency of 8 kHz, etc., so that the analog speech signal undergoes A/D conversion from an analog signal into a digital speech signal. Furthermore, the A/D conversion section 2 performs quantization of the signal with a predetermined number of bits and supplies the signal to an arithmetic unit 3 and an LPC (Linear Prediction Coefficient) analysis section 4.

The LPC analysis section 4 assumes a length, for example, of 160 samples of an speech signal from the A/D conversion section 2 to be one frame, divides that frame into subframes every 40 samples, and performs LPC analysis for each subframe in order to determine linear predictive coefficients $\alpha_1, \alpha_2, \ldots, \alpha_p$ of the P order. Then, the LPC analysis section 4 assumes a vector in which these linear predictive coefficient $\alpha_p$ (p=1, 2, . . . , P) of the P order are elements, as a speech feature vector, to a vector quantization section 5.

The vector quantization section 5 stores a codebook in which a code vector having linear predictive coefficients as elements corresponds to codes, performs vector quantization on a feature vector $\alpha$ from the LPC analysis section 4 on the basis of the codebook, and supplies the codes (hereinafter referred to as an "A_code" as appropriate) obtained as a result of the vector quantization to a code determination section 15.

Furthermore, the vector quantization section 5 supplies linear predictive coefficients $\alpha_1', \alpha_2', \ldots, \alpha_p'$, which are elements forming a code vector $\alpha'$ corresponding to the A_code, to a speech synthesis filter 6.

The speech synthesis filter 6 is, for example, an IIR (Infinite Impulse Response) type digital filter, which assumes a linear predictive coefficient $\alpha_p'$ (p=1, 2, . . . , P) from the vector quantization section 5 to be a tap coefficient of the IIR filter and assumes a residual signal e supplied from an arithmetic unit 14 to be an input signal, to perform speech synthesis.

More specifically, LPC analysis performed by the LPC analysis section 4 is such that, for the (sample value) $s_n$ of the speech signal at the current time n and past P sample values $s_{n-1}, s_{n-2}, \ldots, s_{n-p}$ adjacent to the above sample value, a linear combination represented by the following equation holds:

$$s_n+\alpha_1 s_{n-1}+\alpha_2 s_{n-2}+\ldots+\alpha_p s_{n-p}=e_n \tag{1}$$

and when linear prediction of a prediction value (linear prediction value) $s_n'$ of the sample value $s_n$ at the current time n is performed using the past P sample values $S_{n-1}, s_{n-2}, \ldots, s_{n-p}$ on the basis of the following equation:

$$s_n'=-(\alpha_1 s_{n-1}+\alpha_2 s_{n-2}+\ldots+\alpha_p s_{n-p}) \tag{2}$$

a linear predictive coefficient $\alpha_p$ that minimizes the square error between the actual sample value $s_n$ and the linear prediction value $s_n'$ is determined.

Here, in equation (1), $\{e_n\}$ ( . . . , $e_{n-1}, e_n, e_{n+1}, \ldots$ ) are probability variables, which are uncorrelated with each other, in which the average value is 0 and the variance is a predetermined value $\sigma^2$.

Based on equation (1), the sample value $s_n$ can be expressed by the following equation:

$$s_n=e_n-(\alpha_1 s_{n-1}+\alpha_2 s_{n-2}+\ldots+\alpha_p s_{n-p}) \tag{3}$$

When this is subjected to Z-transformation, the following equation is obtained:

$$S=E/(1+\alpha_1 z^{-1}+\alpha_2 z^{-2}+\ldots+\alpha_p z^{-p}) \tag{4}$$

where, in equation (4), S and E represent Z-transformation of $s_n$ and $_{en}$ in equation (3), respectively.

Here, based on equations (1) and (2), $e_n$ can be expressed by the following equation:

$$e_n=s_n-s_n' \tag{5}$$

and this is called the "residual signal" between the actual sample value $s_n$ and the linear prediction value $s_n'$.

Therefore, based on equation (4), the speech signal $s_n$ can be determined by assuming the linear predictive coefficient $\alpha_p$ to be a tap coefficient of the IIR filter and by assuming the residual signal $e_n$ to be an input signal of the IIR filter.

Therefore, as described above, the speech synthesis filter 6 assumes the linear predictive coefficient $\alpha_p'$ from the vector quantization section 5 to be a tap coefficient, assumes the residual signal e supplied from the arithmetic unit 14 to be an input signal, and computes equation (4) in order to determine an speech signal (synthesized speech data) ss.

In the speech synthesis filter 6, a linear predictive coefficient $\alpha_p'$ as a code vector corresponding to the code obtained as a result of the vector quantization is used instead of the linear predictive coefficient $\alpha_p$ obtained as a result of the LPC analysis by the LPC analysis section 4. As a result, basically, the synthesized speech signal output from the speech synthesis filter 6 does not become the same as the speech signal output from the A/D conversion section 2.

The synthesized speech data ss output from the speech synthesis filter 6 is supplied to the arithmetic unit 3. The arithmetic unit 3 subtracts an speech signal s output by the A/D conversion section 2 from the synthesized speech data ss from the speech synthesis filter 6 (subtracts the sample of the speech data s corresponding to that sample from each sample of the synthesized speech data ss), and supplies the subtracted value to a square-error computation section 7. The A/D conversion section 7 computes the sum of squares (sum of squares of the subtracted value of each sample value of the k-th subframe) of the subtracted value from the arithmetic unit 3 and supplies the resulting square error to a least-square error determination section 8.

The least-square error determination section 8 has stored therein an L code (L_code) as a code indicating a long-term prediction lag, a G code (G_code) as a code indicating a gain, and an I code (I_code) as a code indicating a codeword (excitation codebook) in such a manner as to correspond to the square error output from the square-error computation section 7, and outputs the L_code, the G code, and the L code corresponding to the square error output from the square-error computation section 7. The L code is supplied to an adaptive codebook storage section 9. The G code is supplied to a gain decoder 10. The I code is supplied to an excitation-codebook storage section 11. Furthermore, the L code, the G code, and the I code are also supplied to the code determination section 15.

The adaptive codebook storage section 9 has stored therein an adaptive codebook in which, for example, a 7-bit L code corresponds to a predetermined delay time (lag). The adaptive codebook storage section 9 delays the residual signal e supplied from the arithmetic unit 14 by a delay time (a long-term prediction lag) corresponding to the L code supplied from the least-square error determination section 8 and outputs the signal to an arithmetic unit 12.

Here, since the adaptive codebook storage section 9 delays the residual signal e by a time corresponding to the L code and outputs the signal, the output signal becomes a signal close to a period signal in which the delay time is a period. This signal becomes mainly a driving signal for generating synthesized speech of voiced sound in speech synthesis using linear predictive coefficients. Therefore, the L code conceptually represents a pitch period of speech. According to the standards of CELP, the L code takes an integer value in the range 20 to 146.

A gain decoder 10 has stored therein a table in which the G code corresponds to predetermined gains β and γ, and outputs gains β and γ corresponding to the G code supplied from the least-square error determination section 8. The gains β and γ are supplied to the arithmetic units 12 and 13, respectively. Here, the gain β is what is commonly called a long-term filter status output gain, and the gain γ is what is commonly called an excitation codebook gain.

The excitation-codebook storage section 11 has stored therein an excitation codebook in which, for example, a 9-bit I code corresponds to a predetermined excitation signal, and outputs, to the arithmetic unit 13, the excitation signal which corresponds to the I code supplied from the least-square error determination section 8.

Here, the excitation signal stored in the excitation codebook is, for example, a signal close to white noise, and becomes mainly a driving signal for generating synthesized speech of unvoiced sound in the speech synthesis using linear predictive coefficients.

The arithmetic unit 12 multiplies the output signal of the adaptive codebook storage section 9 with the gain β output from the gain decoder 10 and supplies the multiplied value 1 to the arithmetic unit 14. The arithmetic unit 13 multiplies the output signal of the excited codebook storage section 11 with the gain γ output from the gain decoder 10 and supplies the multiplied value n to the arithmetic unit 14. The arithmetic unit 14 adds together the multiplied value 1 from the arithmetic unit 12 with the multiplied value n from the arithmetic unit 13, and supplies the added value as the residual signal e to the speech synthesis filter 6 and the adaptive codebook storage section 9.

In the speech synthesis filter 6, in the manner described above, the residual signal e supplied from the arithmetic unit 14 is filtered by the IIR filter in which the linear predictive coefficient $\alpha_p'$ supplied from the vector quantization section 5 is a tap coefficient, and the resulting synthesized speech data is supplied to the arithmetic unit 3. Then, in the arithmetic unit 3 and the square-error computation section 7, processes similar to the above-described case are performed, and the resulting square error is supplied to the least-square error determination section 8.

The least-square error determination section 8 determines whether or not the square error from the square-error computation section 7 has become a minimum (local minimum). Then, when the least-square error determination section 8 determines that the square error has not become a minimum, the least-square error determination section 8 outputs the L code, the G code, and the I code corresponding to the square error in the manner described above, and hereafter, the same processes are repeated.

On the other hand, when the least-square error determination section 8 determines that the square error has become a minimum, the least-square error determination section 8 outputs the determination signal to the code determination section 15. The code determination section 15 latches the A code supplied from the vector quantization section 5 and latches the L code, the G code, and the I code in sequence supplied from the least-square error determination section 8. When the determination signal is received from the least-square error determination section 8, the code determination section 15 supplies the A code, the L code, the G code, and the I code, which are latched at this time, to the channel encoder 16. The channel encoder 16 multiplexes the A code, the L code, the G code, and the I code from the code determination section 15 and outputs them as code data. This code data is transmitted via a transmission path.

Based on the above, the code data is coded data having the A code, the L code, the G code, and the I code, which are information used for decoding, in units of subframes.

Here, the A code, the L code, the G code, and the I code are determined for each subframe. However, for example, there is a case in which the A code is sometimes determined for each frame. In this case, to decode the four subframes which form that frame, the same A code is used. However, also, in this case, each of the four subframes which form that one frame can be regarded as having the same A code. In this way, the code data can be regarded as being formed as coded data having the A code, the L code, the G code, and the I code, which are information used for decoding, in units of subframes.

Here, in FIG. 1 (the same applies also in FIGS. 2, 5, 9, 11, 16, 18, and 21, which will be described later), [k] is assigned to each variable so that the variable is an array variable. This k represents the number of subframes, but in the specification, a description thereof is omitted where appropriate.

Next, the code data transmitted from the transmission section of another mobile phone in the above-described manner is received by a channel decoder 21 of the receiving section shown in FIG. 2. The channel decoder 21 separates the L code, the G code, the I code; and the A code from the code data, and supplies each of them to an adaptive codebook storage section 22, a gain decoder 23, an excitation codebook storage section 24, and a filter coefficient decoder 25.

The adaptive codebook storage section 22, the gain decoder 23, the excitation codebook storage section 24, and arithmetic units 26 to 28 are formed similarly to the adaptive codebook storage section 9, the gain decoder 10, the excited codebook storage section 11, and the arithmetic units 12 to 14 of FIG. 1, respectively. As a result of the same processes as in the case described with reference to FIG. 1 being performed, the L code, the G code, and the I code are decoded into the residual signal e. This residual signal e is provided as an input signal to a speech synthesis filter 29.

The filter coefficient decoder 25 has stored therein the same codebook as that stored in the vector quantization section 5 of FIG. 1, so that the A code is decoded into a linear predictive coefficient $\alpha_p'$ and this is supplied to the speech synthesis filter 29.

The speech synthesis filter 29 is formed similarly to the speech synthesis filter 6 of FIG. 1. The speech synthesis filter 29 assumes the linear predictive coefficient $\alpha_p'$ from the filter coefficient decoder 25 to be a tap coefficient, assumes the residual signal e supplied from an arithmetic unit 28 to be an input signal, and computes equation (4), thereby generating synthesized speech data when the square error is determined to be a minimum in the least-square error determination section 8 of FIG. 1. This synthesized speech data is supplied to a D/A (Digital/Analog) conversion section 30. The D/A conversion section 30 subjects the synthesized speech data from the speech synthesis filter 29 to D/A conversion from a digital signal into an analog signal, and supplies the analog signal to a speaker 31, whereby the analog signal is output.

In the code data, when the A codes are arranged in frame units rather than in subframe units, in the receiving section of FIG. 2, linear predictive coefficients corresponding to the A codes arranged in that frame can be used to decode all four subframes which form the frame. In addition, interpolation is performed on each subframe by using the linear predictive coefficients corresponding to the A code of the adjacent frame, and the linear predictive coefficients obtained as a result of the interpolation can be used to decode each subframe.

As described above, in the transmission section of the mobile phone, since the residual signal and linear predictive coefficients, as an input signal provided to the speech synthesis filter 29 of the receiving section, are coded and then transmitted, in the receiving section, the codes are decoded into a residual signal and linear predictive coefficients. However, since the decoded residual signal and linear predictive coefficients (hereinafter referred to as "decoded residual signal and decoded linear predictive coefficients", respectively, as appropriate) contain errors such as quantization errors, these do not match the residual signal and the linear predictive coefficients obtained by performing LPC analysis on speech.

For this reason, the synthesized speech data output from the speech synthesis filter 29 of the receiving section becomes deteriorated sound quality in which distortion, etc., is contained.

DISCLOSURE OF THE INVENTION

The present invention has been made in view of such circumstances, and aims to obtain high-quality synthesized speech, etc.

A first data processing apparatus of the present invention comprises: tap generation means for generating, from subject data of interest within predetermined data, a tap used for a predetermined process by extracting predetermined data according to period information; and processing means for performing a predetermined process on the subject data by using the tap.

A first data processing method of the present invention comprises: a tap generation step of generating, from subject data of interest within the predetermined data, a tap used for a predetermined process by extracting predetermined data according to period information; and a processing step of performing a predetermined process on the subject data by using the tap.

A first program of the present invention comprises: a tap generation step of generating, from subject data of interest within predetermined data, a tap used for a predetermined process by extracting the predetermined data according to period information; and a processing step of performing a predetermined process on the subject data by using the tap.

A first recording medium of the present invention comprises: a tap generation step of generating, from subject data of interest within predetermined data, a tap used for a predetermined process by extracting the predetermined data according to period information; and a processing step of performing a predetermined process on the subject data by using the tap.

A second data processing apparatus of the present invention comprises: student data generation means for generating, from teacher data serving as a teacher for learning, predetermined data and period information as student data serving as a student for learning; prediction tap generation means for generating a prediction tap used to predict the teacher data by extracting the predetermined data from subject data of interest within the predetermined data as the student data according to the period information; and learning means for performing learning so that a prediction error of a prediction value of the teacher data obtained by performing predetermined prediction computation by using the prediction tap and the tap coefficient statistically becomes a minimum and for determining the tap coefficient.

A second data processing method of the present invention comprises: a student data generation step of generating, from teacher data serving as a teacher for learning, predetermined data and period information as student data serving as a student for learning; a prediction tap generation step of generating a prediction tap used to predict the teacher data by extracting the predetermined data from subject data of interest within the predetermined data as the student data according to the period information; and a learning step of performing learning so that a prediction error of a prediction value of the teacher data obtained by performing predetermined prediction computation by using the prediction tap and the tap coefficient statistically becomes a minimum and for determining the tap coefficient.

A second program of the present invention comprises: a student data generation step of generating, from teacher data serving as a teacher for learning, predetermined data and period information as student data serving as a student for learning; a prediction tap generation step of generating a prediction tap used to predict the teacher data by extracting the predetermined data from subject data of interest within the predetermined data as the student data according to the period information; and a learning step of performing learning so that a prediction error of a prediction value of the teacher data obtained by performing predetermined prediction computation by using the prediction tap and the tap coefficient statistically becomes a minimum and for determining the tap coefficient.

A second recording medium of the present invention comprises: a student data generation step of generating, from teacher data serving as a teacher for learning, predetermined data and period information as student data serving as a student for learning; a prediction tap generation step of generating a prediction tap used to predict the teacher data by extracting the predetermined data from subject data of interest within the predetermined data as the student data according to the period information; and a learning step of performing learning so that a prediction error of a prediction value of the teacher data obtained by performing predetermined prediction computation by using the prediction tap and the tap coefficient statistically becomes a minimum and for determining the tap coefficient.

In the first data processing apparatus, data processing method, program, and recording medium, by extracting predetermined data from subject data of interest within predetermined data according to period information, a tap used for a predetermined process is generated, and the predetermined process is performed on the subject data by using the tap.

In the second data processing apparatus, data processing method, program, and recording medium of the present invention, predetermined data and period information are generated as student data serving as a student for learning from teacher data serving as a teacher for learning. Then, by extracting predetermined data from subject data within the predetermined data as the student data according to the period information, a prediction tap used to predict teacher data is generated, and learning is performed so that a prediction error of a prediction value of the teacher data obtained by performing a predetermined prediction computation statistically becomes a minimum, and a tap coefficient is determined.

BEST MODE FOR CARRYING OUT THE INVENTION

Figure 3:
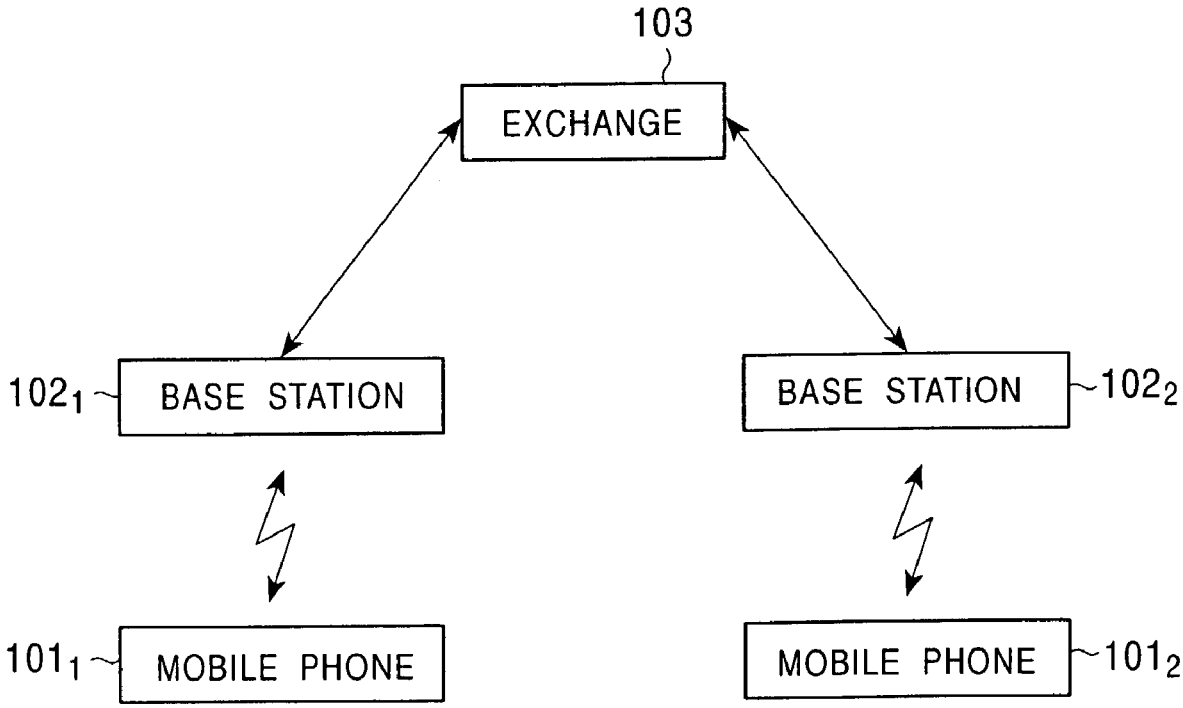
FIG. 3 shows an example of the configuration of an embodiment of a transmission system according to the present invention.

FIG. 3 shows the configuration of one embodiment of a transmission system ("system" refers to a logical assembly of a plurality of apparatuses, and it does not matter whether or not the apparatus of each configuration is in the same housing) to which the present invention is applied.

In this transmission system, mobile phones $\mathbf{101}_1$ and $\mathbf{101}_2$ perform wireless transmission and reception with base stations $\mathbf{102}_1$ and $\mathbf{102}_2$, respectively, and each of the base stations $\mathbf{102}_1$ and $\mathbf{102}_2$ performs transmission and reception with an exchange station 103, so that, finally, speech transmission and reception can be performed between the mobile phones $\mathbf{101}_1$ and $\mathbf{101}_2$ via the base stations $\mathbf{102}_1$ and $\mathbf{102}_2$ and the exchange station 103. The base stations $\mathbf{102}_1$ and $\mathbf{102}_2$ may be the same base station or different base stations.

Hereinafter, the mobile phones $\mathbf{101}_1$ and $\mathbf{101}_2$ will be described as a "mobile phone 101" unless it is not particularly necessary to be identified.

Figure 4:
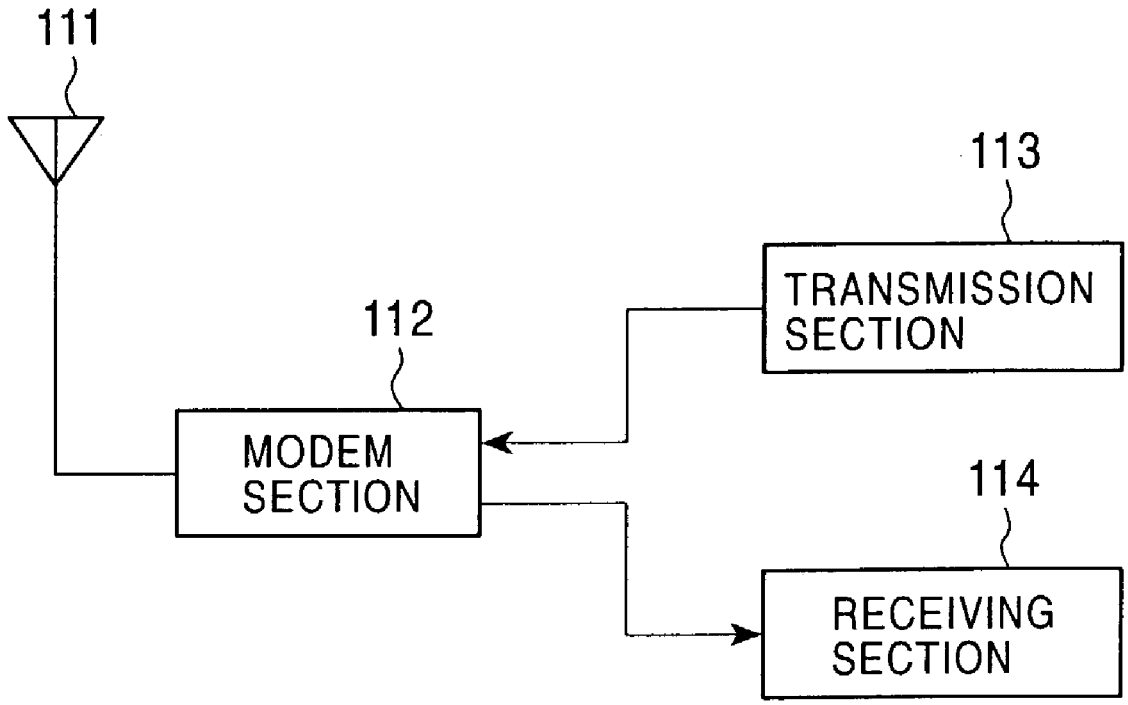
FIG. 4 is a block diagram showing an example of the configuration of mobile phones $\mathbf{101}_1$ and $\mathbf{101}_2$.

Next, FIG. 4 shows an example of the configuration of the mobile phone 101 of FIG. 3.

In this mobile phone 101, speech transmission and reception is performed in accordance with a CELP method.

More specifically, an antenna 111 receives radio waves from the base station $\mathbf{102}_1$ or $\mathbf{102}_2$, supplies the received signal to a modem section 112, and transmits the signal from the modem section 112 to the base station $\mathbf{102}_1$ or $\mathbf{102}_2$ in the form of radio waves. The modem section 112 demodulates the signal from the antenna 111 and supplies the resulting code data, such as that described in FIG. 1, to the receiving section 114. Furthermore, the modem section 112 modulates code data, such as that described in FIG. 1, supplied from the transmission section 113, and supplies the resulting modulation signal to the antenna 111. The transmission section 113 is formed similarly to the transmission section shown in FIG. 1, codes the speech of the user, input thereto, into code data by a CELP method, and supplies the data to the modem section 112. The receiving section 114 receives the code data from the modem section 112, decodes the code data by the CELP method, and decodes high-quality sound and outputs it.

More specifically, in the receiving section 114, synthesized speech decoded by the CELP method using, for example, a classification and adaptation process is further decoded into (the prediction value of) true high-quality sound.

Here, the classification and adaptation process is formed of a classification process and an adaptation process, so that data is classified according to the properties thereof by the classification process, and an adaptation process is performed for each class. The adaptation process is such as that described below.

That is, in the adaptation process, for example, a prediction value of high-quality sound is determined by linear combination of synthesized speech and a predetermined tap coefficient.

Figure 2:
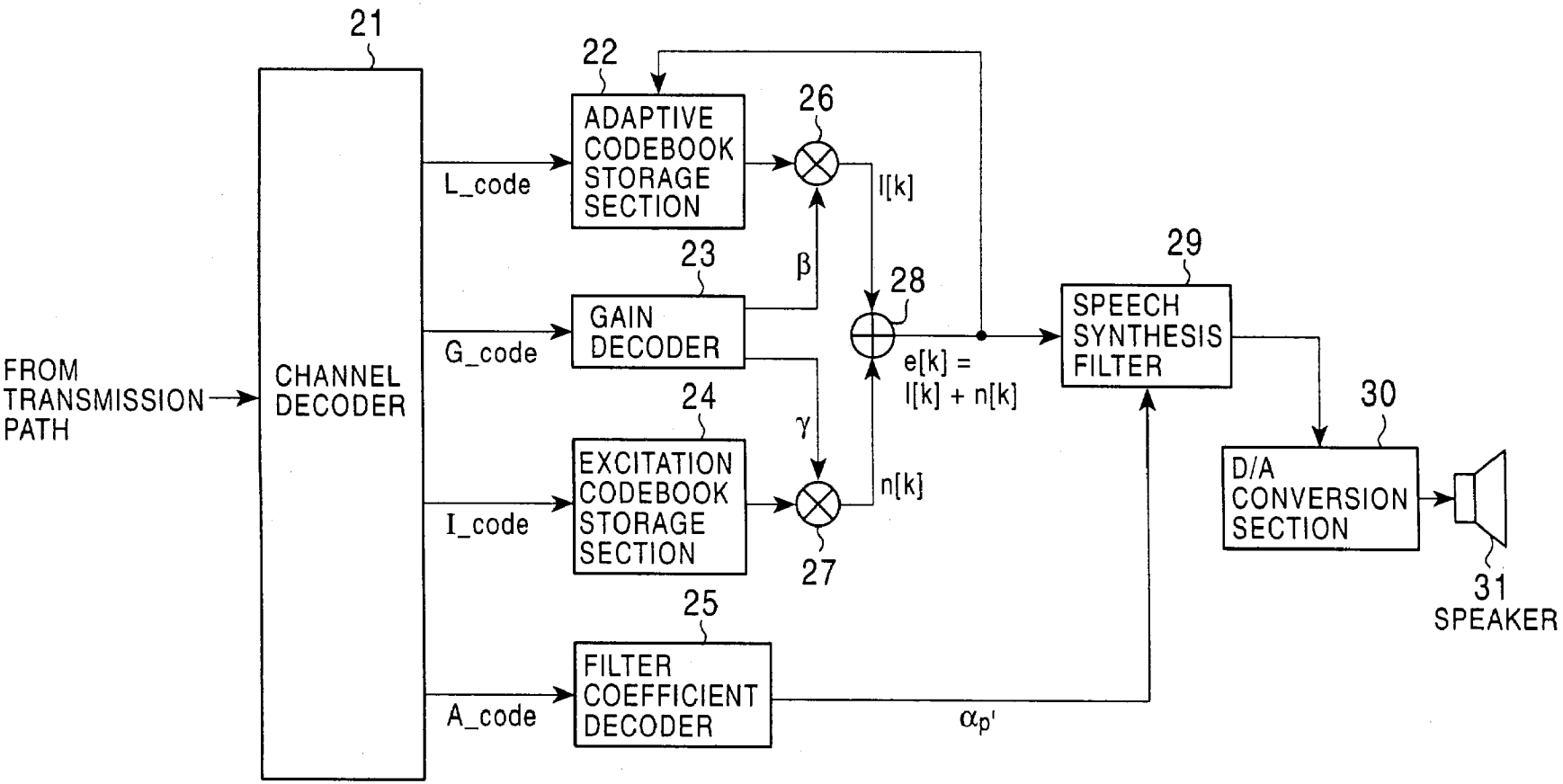
FIG. 2 is a block diagram showing the configuration of an example of a receiving section of a conventional mobile phone.

More specifically, it is considered that, for example, (the sample value of) high-quality sound is assumed to be teacher data, and the synthesized speech obtained in such a way that the high-quality sound is coded into an L code, a G code, an I code, and an A code by the CELP method and these codes are decoded by the receiving section shown in FIG. 2 is assumed to be student data, and that a prediction value E[y] of high-quality sound y which is teacher data is determined by a linear first-order combination model defined by a linear combination of a set of several (sample values of) synthesized speeches $x_1, x_2, \ldots$ and predetermined tap coefficients $w_1, w_2, \ldots$ In this case, the prediction value E[y] can be expressed by the following equation:

$$E[y]=w_1x_1+w_2x_2, \ldots$$

To generalize equation (1), when a matrix W is composed of a set of tap coefficients $w_j$, a matrix X composed of a set of student data $x_{ij}$ and a matrix Y' composed of prediction values $E[y_j]$ are defined by the following:

[Equation 1]

$$X = \begin{bmatrix} x_{11} & x_{12} & \cdots & x_{1J} \\ x_{21} & x_{22} & \cdots & x_{2J} \\ \cdots & \cdots & \cdots & \cdots \\ x_{I1} & x_{I2} & \cdots & x_{IJ} \end{bmatrix}$$

$$W = \begin{bmatrix} W_1 \\ W_2 \\ \cdots \\ W_J \end{bmatrix}, Y' = \begin{bmatrix} E[y_1] \\ E[y_2] \\ \cdots \\ E[y_I] \end{bmatrix}$$

the following observation equations holds:

$$XW=Y' \tag{7}$$

where the component $x_{ij}$ of the matrix X means the j-th student data within the set of the i-th student data (the set of student data used to predict the i-th teacher data $y_i$), and the component $w_j$ of the matrix W indicates a tap coefficient with which the product with the j-th student data within the set of student data is computed. Furthermore, $y_i$ indicates the i-th teacher data, and therefore, $E[y_i]$ indicates the prediction value of the i-th teacher data. y on the left side of equation (6) is such that the suffix i of the component $y_i$ of the matrix Y is omitted. Furthermore, $x_1, x_2, \ldots$ on the right side of equation (6) are such that the suffix i of the component $x_{ij}$ of the matrix X is omitted.

Then, it is considered that a least-square method is applied to this observation equation in order to determine a prediction value E[y] close to the true high-quality sound y. In this case, when the matrix Y composed of a set of sounds y of true high sound quality, which becomes teacher data, and a matrix E composed of a set of residuals e of the prediction value E[y] with respect to the high-quality sound y are defined by the following:

[Equation 2]

$$E = \begin{bmatrix} e_1 \\ e_2 \\ \cdots \\ e_I \end{bmatrix}, Y = \begin{bmatrix} y_1 \\ y_2 \\ \cdots \\ y_I \end{bmatrix}$$

the following residual equation holds on the basis of equation (7):

$$XW=Y+E \tag{8}$$

In this case, the tap coefficient $w_j$ for determining the prediction value E[y] close to the original speech y of high sound quality can be determined by minimizing the square error:

[Equation 3]

$$\sum_{i=1}^{I} e_i^2$$

Therefore, when the above-described square error differentiated by the tap coefficient $w_j$ becomes 0, it follows that the tap coefficient $w_j$ that satisfies the following equation will be the optimum value for determining the prediction value E[y] close to the original speech y of high sound quality.

[Equation 4]

$$e_1\frac{\partial e_1}{\partial w_j} + e_2\frac{\partial e_2}{\partial w_j} + \ldots + e_I\frac{\partial e_I}{\partial w_j} = 0 (j = 1, 2, \ldots, J) \tag{9}$$

Accordingly, first, by differentiating equation (8) with the tap coefficient $w_j$, the following equations hold:

[Equation 5]

$$\frac{\partial e_i}{\partial w_1} = x_{i1}, \frac{\partial e_i}{\partial w_2} = x_{i2}, \ldots, \frac{\partial e_i}{\partial w_J} = x_{iJ}, (i = 1, 2, \ldots, I) \tag{10}$$

Equations (11) are obtained on the basis of equations (9) and (10):

[Equation 6]

$$\sum_{i=1}^{I} e_i x_{i1} = 0, \sum_{i=1}^{I} e_i x_{i2} = 0, \ldots \sum_{i=1}^{I} e_i x_{iJ} = 0 \tag{11}$$

Furthermore, when the relationships among the student data $x_{ij}$, the tap coefficient $w_j$, the teacher data $y_i$, and the error $e_i$ in the residual equation of equation (8) are taken into consideration, the following normalization equations can be obtained on the basis of equations (11):

[Equation 7]

$$\begin{cases} \left(\sum_{i=1}^{I} X_{i1}X_{i1}\right)W_1 + \left(\sum_{i=1}^{I} X_{i1}X_{i2}\right)W_2 + \ldots + \left(\sum_{i=1}^{I} X_{i1}X_{iJ}\right)W_J = \left(\sum_{i=1}^{I} X_{i1}y_i\right) \\ \left(\sum_{i=1}^{I} X_{i2}X_{i1}\right)W_1 + \left(\sum_{i=1}^{I} X_{i2}X_{i2}\right)W_2 + \ldots + \left(\sum_{i=1}^{I} X_{i2}X_{iJ}\right)W_J = \left(\sum_{i=1}^{I} X_{i2}y_i\right) \\ \left(\sum_{i=1}^{I} X_{iJ}X_{i1}\right)W_1 + \left(\sum_{i=1}^{I} X_{iJ}X_{i2}\right)W_2 + \ldots + \left(\sum_{i=1}^{I} X_{iJ}X_{iJ}\right)W_J = \left(\sum_{i=1}^{I} X_{iJ}y_i\right) \end{cases} \quad (12)$$

When the matrix (covariance matrix) A and a vector v are defined on the basis of:

[Equation 8]

$$A = \begin{pmatrix} \sum_{i=1}^{I} x_{i1}x_{i1} & \sum_{i=1}^{I} x_{i1}x_{i2} & \cdots & \sum_{i=1}^{I} x_{i1}x_{iJ} \\ \sum_{i=1}^{I} x_{i2}x_{i1} & \sum_{i=1}^{I} x_{i2}x_{i2} & \cdots & \sum_{i=1}^{I} x_{i2}x_{iJ} \\ \sum_{i=1}^{I} x_{iJ}x_{i1} & \sum_{i=1}^{I} x_{iJ}x_{i2} & \cdots & \sum_{i=1}^{I} x_{iJ}x_{iJ} \end{pmatrix}$$

$$v = \begin{pmatrix} \sum_{i=1}^{I} x_{i1}y_i \\ \sum_{i=1}^{I} x_{i2}y_i \\ \cdots \\ \sum_{i=1}^{I} x_{iJ}y_i \end{pmatrix}$$

and when a vector W is defined as shown in equation 1, the normalization equation shown in equations (12) can be expressed by the following equation:

$$AW=v \quad (13)$$

Each normalization equation in equation (12) can be formulated by the same number as the number J of the tap coefficient $w_j$ to be determined by preparing the set of the student data $x_{ij}$ and the teacher data $y_i$ by a certain degree of number. Therefore, solving equation (13) with respect to the vector W (however, to solve equation (13), it is required that the matrix A in equation (13) be regular) enables the optimum tap coefficient (here, a tap coefficient that minimizes the square error) $w_j$ to be determined. When solving equation (13), for example, a sweeping-out method (Gauss-Jordan's elimination method), etc., can be used.

The adaptation process determines, in the above-described manner, the optimum tap coefficient $w_j$ in advance, and the tap coefficient $w_j$ is used to determine, based on equation (6), the predictive value E[y] close to the true high-quality sound y.

For example, in a case where, as the teacher data, an speech signal which is sampled at a high sampling frequency or an speech signal to which many bits are assigned is used, and as the student data, synthesized speech obtained in such a way that the speech signal as the teacher data is thinned or an speech signal which is requantized with a small number of bits is coded by the CELP method and the coded result is decoded is used, regarding the tap coefficient, when an speech signal which is sampled at a high sampling frequency or an speech signal to which many bits are assigned is to be generated, high-quality sound in which the prediction error statistically becomes a minimum is obtained. Therefore, in this case, it is possible to obtain higher-quality synthesized speech.

In the receiving section 114 of FIG. 4, the classification and adaptation process such as that described above decodes the synthesized speech obtained by decoding code data into higher-quality sound.

Figure 5:
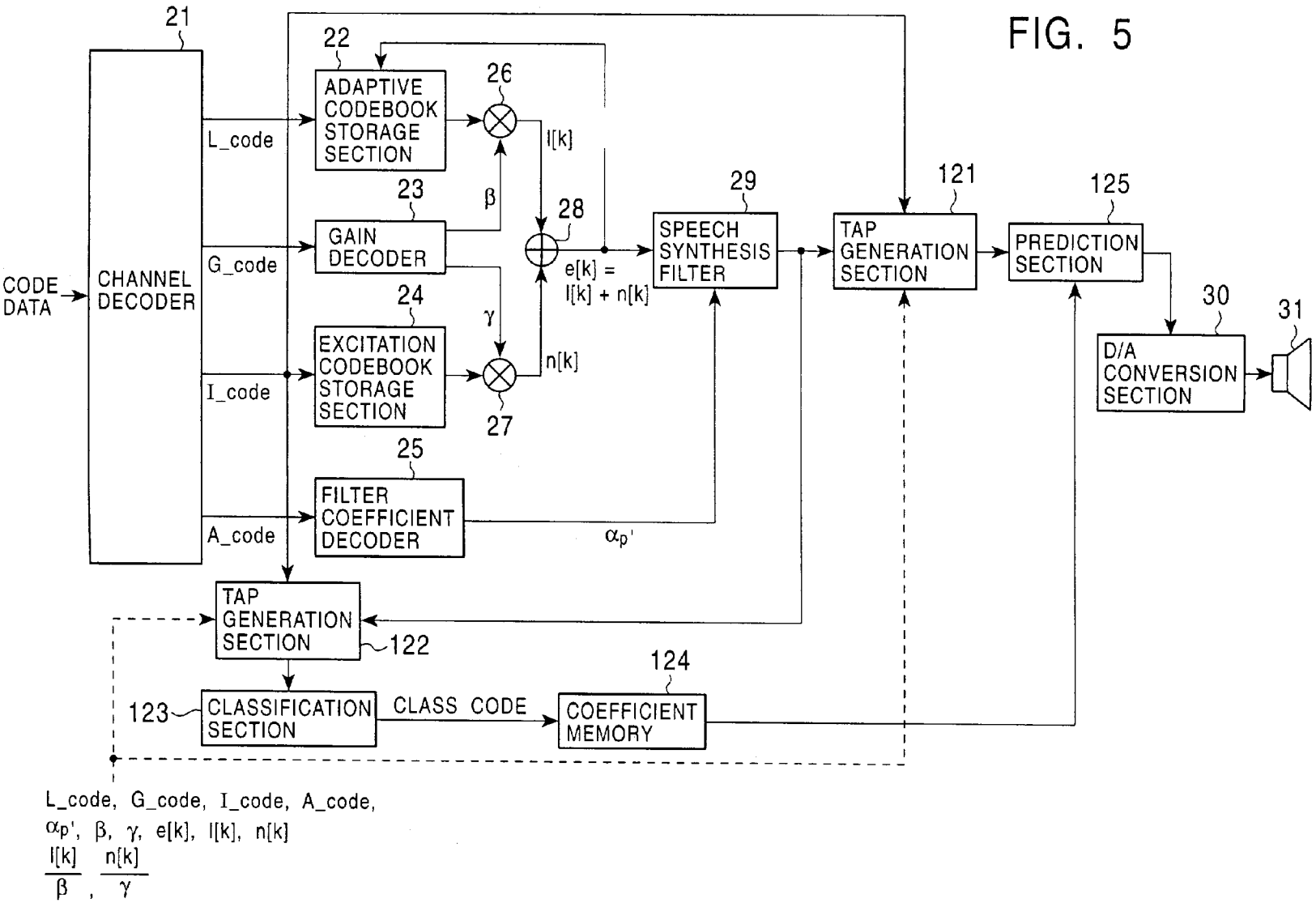
FIG. 5 is a block diagram showing an example of a first configuration of a receiving section 114.

More specifically, FIG. 5 shows an example of a first configuration of the receiving section 114. Components in FIG. 5 corresponding to the case in FIG. 2 are given the same reference numerals, and in the following, descriptions thereof are omitted where appropriate.

Synthesized speech data for each subframe, which is output from the speech synthesis filter 29, and the L code among the L code, the G code, the I code, and the A code for each subframe, which are output from the channel decoder 21, are supplied to the tap generation sections 121 and 122. The tap generation sections 121 and 122 extract, based on the L code, data used as a prediction tap used to predict the prediction value of high-quality sound and data used as a class tap used for classification from the synthesized speech data supplied to the tap generation sections 121 and 122, respectively. The prediction tap is supplied to a prediction section 125, and the class tap is supplied to a classification section 123.

The classification section 123 performs classification on the basis of the class tap supplied from the tap generation section 122, and supplies the class code as the classification result to a coefficient memory 124.

Here, as a classification method in the classification section 123, there is a method using, for example, a K-bit ADRC (Adaptive Dynamic Range Coding) process.

Here, in the K-bit ADRC process, for example, a maximum value MAX and a minimum value MIN of the data forming the class tap are detected, and DR=MAX−MIN is assumed to be a local dynamic range of a set. Based on this dynamic range DR, each piece of data which forms the class tap is requantized to K bits. That is, the minimum value MIN is subtracted from each piece of data which forms the class tap, and the subtracted value is divided (quantized) by $DR/2^K$. Then, a bit sequence in which the values of the K bits of each piece of data which forms the class tap are arranged in a predetermined order is output as an ADRC code.

When such a K-bit ADRC process is used for classification, for example, it is possible to use the ADRC code obtained as a result of the K-bit ADRC process as a class code.

In addition, for example, the classification can also be performed by considering a class tap as a vector in which each piece of data which forms the class tap is an element and by performing vector quantization on the class tap as the vector.

The coefficient memory 124 stores tap coefficients for each class, obtained as a result of a learning process being performed in the learning apparatus of FIG. 9, which will be described later, and supplies to the prediction section 125 a tap coefficient stored at the address corresponding to the class code output from the classification section 123.

The prediction section 125 obtains the prediction tap output from the tap generation section 121 and the tap coefficient output from the coefficient memory 124, and performs the linear prediction computation shown in equation (6) by using the prediction tap and the tap coefficient. As a result, the prediction section 125 determines (the prediction value of the) high-quality sound with respect to the subject subframe of interest and supplies the value to the D/A conversion section 30.

Figure 6:
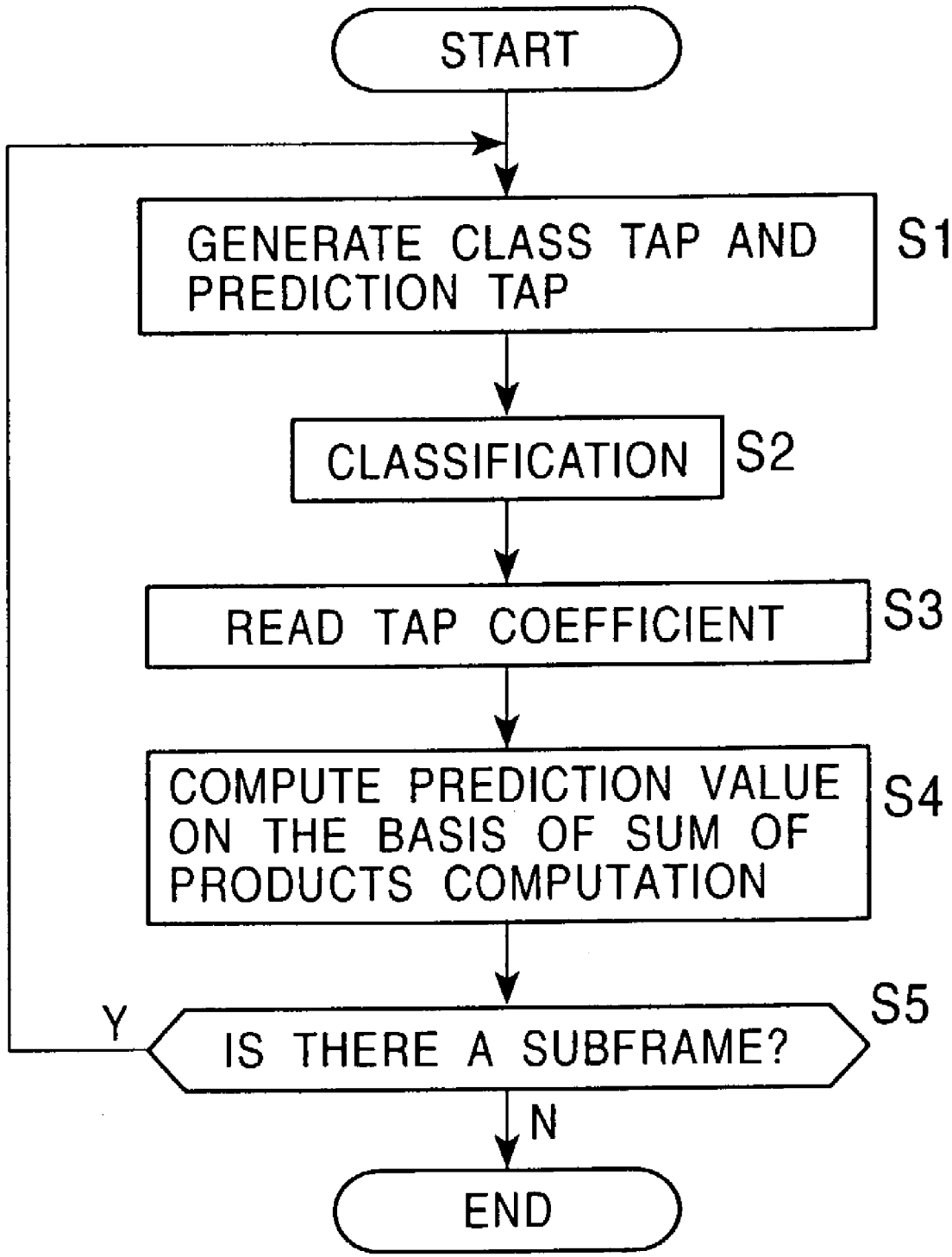
FIG. 6 is a flowchart illustrating processes of the receiving section 114 of FIG. 5.

Next, referring to the flowchart in FIG. 6, a description is given of a process of the receiving section 114 of FIG. 5.

The channel decoder 21 separates an L code, a G code, an I code, and an A code from the code data supplied thereto, and supplies the codes to the adaptive codebook storage section 22, the gain decoder 23, the excitation codebook storage section 24, and the filter coefficient decoder 25, respectively. Furthermore, the L code is also supplied to the tap generation sections 121 and 122.

Then, the adaptive codebook storage section 22, the gain decoder 23, the excitation codebook storage section 24, and arithmetic units 26 to 28 perform the same processes as in the case of FIG. 2, and as a result, the L code, the G code, and the I code are decoded into a residual signal e. This residual signal is supplied to the speech synthesis filter 29.

Furthermore, as described with reference to FIG. 2, the filter coefficient decoder 25 decodes the A code supplied thereto into a linear prediction coefficient and supplies it to the speech synthesis filter 29. The speech synthesis filter 29 performs speech synthesis by using the residual signal from the arithmetic unit 28 and the linear prediction coefficient from the filter coefficient decoder 25, and supplies the resulting synthesized speech to the tap generation sections 121 and 122.

The tap generation section 121 assumes the subframe of the synthesized speech which is output in sequence by the speech synthesis filter 29 to be a subject subframe in sequence. In step S1, the tap generation section 121 extracts the synthesized speech data of the subject subframe, and extracts the past or future synthesized speech data with respect to time when seen from the subject subframe on the basis of the L code supplied thereto, so that a prediction tap is generated, and supplies the prediction tap to the prediction section 125. Furthermore, in step S1, for example, the tap generation section 122 also extracts the synthesized speech data of the subject subframe, and extracts the past or future synthesized speech data with respect to time when seen from the subject subframe on the basis of the L code supplied thereto, so that a class tap is generated, and supplies the class tap to the classification section 123.

Then, the process proceeds to step S2, where the classification section 123 performs classification on the basis of the class tap supplied from the tap generation section 122, and supplies the resulting class code to the coefficient memory 124, and then the process proceeds to step S3.

In step S3, the coefficient memory 124 reads a tap coefficient from the address corresponding to the class code supplied from the classification section 123, and supplies the tap coefficient to the prediction section 125.

Then, the process proceeds to step S4, where the prediction section 125 obtains the tap coefficient output from the coefficient memory 124, and performs the sum-of-products computation shown in equation (6) by using the tap coefficient and the prediction tap from the tap generation section 121, so that (the prediction value of) the high-quality sound data of the subject subframe is obtained.

The processes of steps S1 to S4 are performed by using each of the sample values of the synthesized speech data of the subject subframe as subject data. That is, since the synthesized speech data of the subframe is composed of 40 samples, as described above, the processes of steps S1 to S4 are performed for each of the synthesized speech data of the 40 samples.

The high-quality sound data obtained in the above-described manner is supplied from the prediction section 125 via the D/A conversion section 30 to a speaker 31, whereby high-quality sound is output from the speaker 31.

After the process of step S4, the process proceeds to step S5, where it is determined whether or not there are any more subframes to be processed as subject subframes. When it is determined that there is a subframe to be processed, the process returns to step SI, where a subframe to be used as the next subject subframe is newly used as a subject subframe, and hereafter, the same processes are repeated. When it is determined in step S5 that there is no subframe to be processed as a subject subframe, the processing is terminated.

Figure 7:
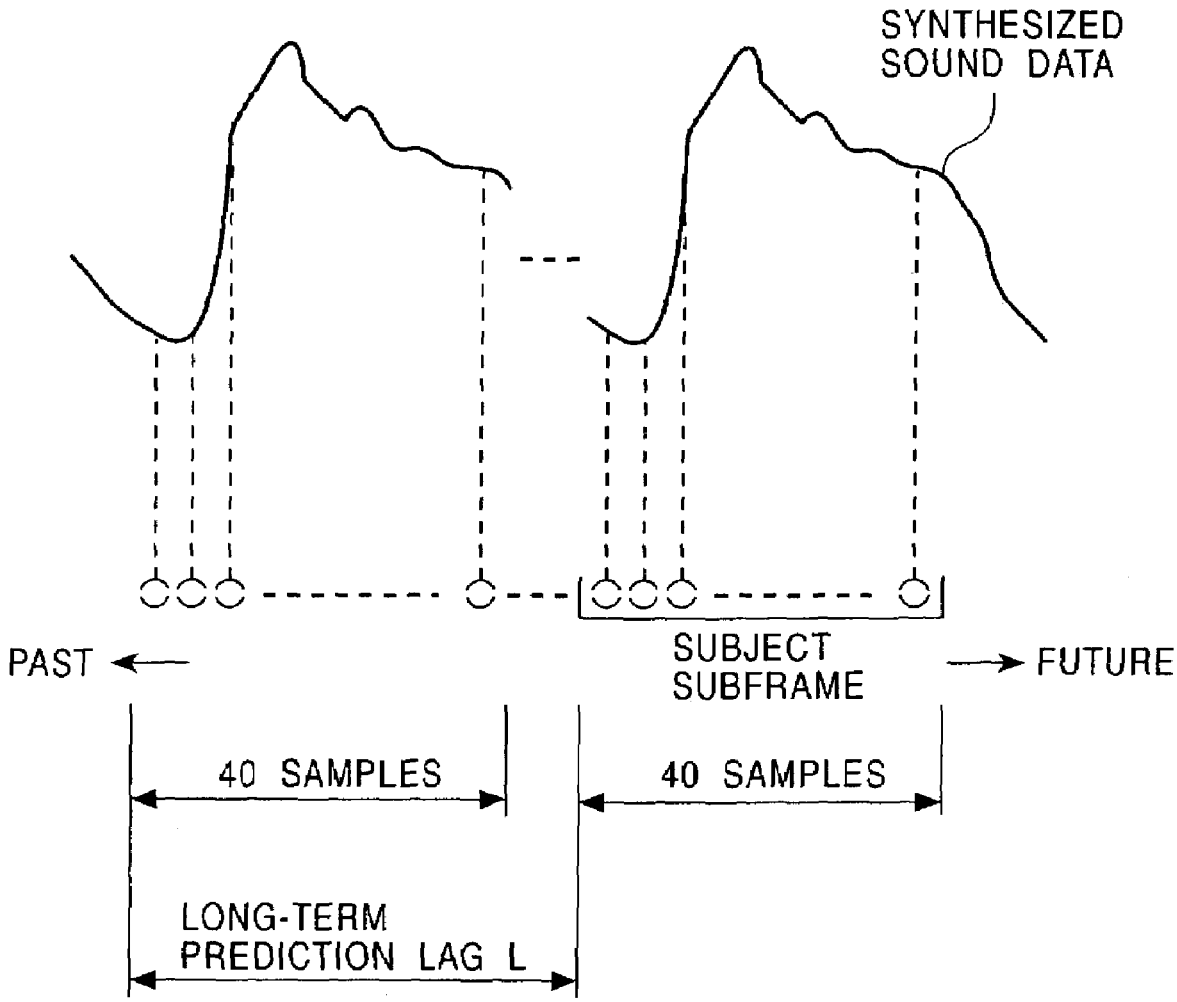
FIG. 7 illustrates a method of generating a prediction tap and a class tap.
Figure 8:
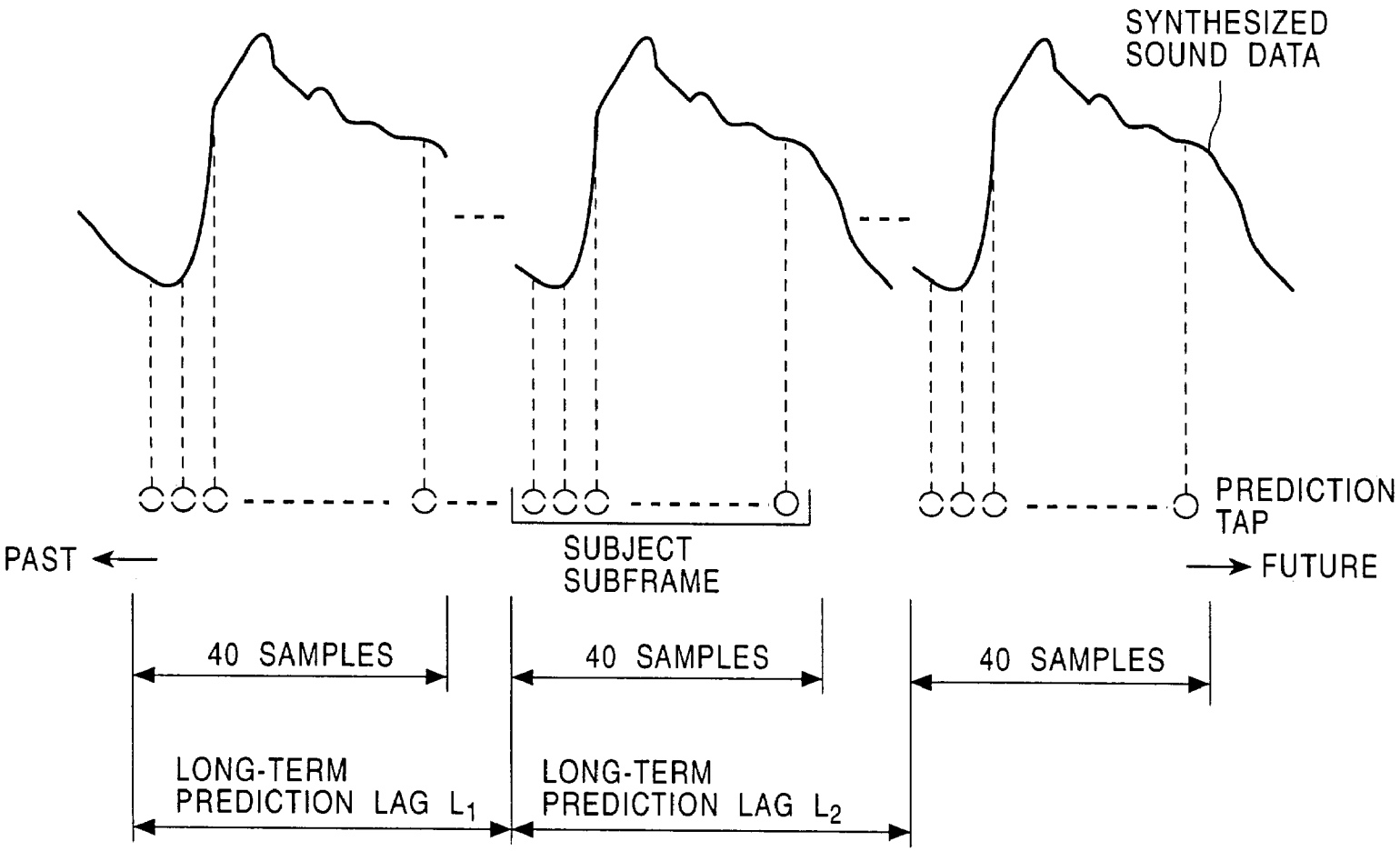
FIG. 8 illustrates a method of generating a prediction tap and a class tap.

Next, referring to FIGS. 7 and 8, a description is given of a method of generating a prediction tap in the tap generation section 121 of FIG. 5.

For example, as shown in FIG. 7, the tap generation section 121 extracts synthesized speech data for 40 samples in the subject subframe, and extracts from the subject subframe the synthesized speech data for 40 samples (hereinafter referred to as a "lag-compensating past data" where appropriate), in which a position in the past by the amount of a lag indicated by the L code located in that subject subframe is a starting point, so that the data is assumed to be a prediction tap for the subject data.

Alternatively, for example, as shown in FIG. 8, the tap generation section 121 extracts synthesized speech data for 40 samples of the subject subframe, and extracts synthesized speech data for 40 samples the future when seen from the subject subframe (hereinafter referred to as a "lag-compensating future data" where appropriate), in which an L code is located such that a position in the past by the lag indicated by the L code is a position of synthesized speech data within the subject subframe (for example, the subject data, etc.), so that the data is used as a prediction tap regarding the subject data.

Furthermore, the tap generation section 121 extracts, for example, the synthesized speech data of the subject subframe, the lag-compensating past data, and the lag-compensating future data so that these are used as a prediction tap for the subject data.

Here, when the subject data is to be predicted by a classification and adaptation process, by using, in addition to the synthesized speech data of the subject subframe, synthesized speech data of the subframe other than the subject subframe as a prediction tap, higher-quality sound can be obtained. In this case, for example, the prediction tap is formed simply the synthesized speech data of the subject subframe and furthermore the synthesized speech data of the subframes immediately before and after the subject subframe.

However, in this manner, when the prediction tap is simply composed of the synthesized speech data of the subject subframe and the synthesized speech data of the subframes immediately before and after the subject subframe, since the waveform characteristics of the synthesized speech data are scarcely taken into consideration in the manner in which the prediction tap is formed, accordingly, it is thought that an influence occurs on higher sound quality.

Therefore, in the manner described above, the tap generation section 121 extracts the synthesized speech data to be used as a prediction tap on the basis of the L code.

That is, since the lag (the long-term prediction lag) indicated by the L code located in the subframe indicates at which point in time during the past the waveform of the synthesized speech of the subject data portion resembles the waveform of the synthesized speech, the waveform of the subject data portion and the waveforms of the lag-compensating past data and the lag-compensating future data portions have a high correlation.

Therefore, by forming the prediction tap using the synthesized speech data of the subject subframe, and one or both of the lag-compensating past data and the lag-compensating future data having a high correlation with respect to that synthesized speech data, it becomes possible to obtain higher-quality sound.

Here, also, in the tap generation section 122 of FIG. 5, for example, in a manner similar to the case in the tap generation section 121, it is possible to generate a class tap from the synthesized speech data of the subject subframe, and one or both of the lag-compensating past data and the lag-compensating future data, and the construction is so formed in the embodiment of FIG. 5.

The formation pattern of the prediction tap and the class tap is not limited to the above-described pattern. That is, in addition to all the synthesized speech data of the subject subframe being contained in the prediction tap and the class tap, only the synthesized speech data every other sample may be contained, and synthesized speech data of the subframe-at a position in the past by the lag indicated by the L code located in that subject subframe may be contained.

Although in the above-described case, the class tap and the prediction tap are formed in the same way, the class tap and the prediction tap may be formed in different ways.

In addition, in the above-described case, the synthesized speech data for 40 samples, located in a subframe in the future when seen from the subject subframe, in which an L code such that a position in the past by the lag indicated by the L code is a position of the synthesized speech data within the subject subframe (for example, the subject data) is located, is contained as lag-compensating future data in the prediction tap. Additionally, as the lag-compensating future data, for example, it is also possible to use synthesized speech data described below.

More specifically, as described above, the L code contained in the coded data in the CELP method indicates the position of the past synthesized speech data resembling the waveform of the synthesized speech data of the subframe in which that L code is located. In addition to the L code indicating the position of such a waveform, an L code indicating the position of a future resembling waveform (hereinafter referred to as a "future L code" where appropriate) can be contained in the coded data. In this case, for the lag-compensating future data with respect to the subject data, it is possible to use one or more samples in which the synthesized speech data at a position in the future by the lag indicated by the future L code located in the subject subframe is a starting point.

Figure 9:
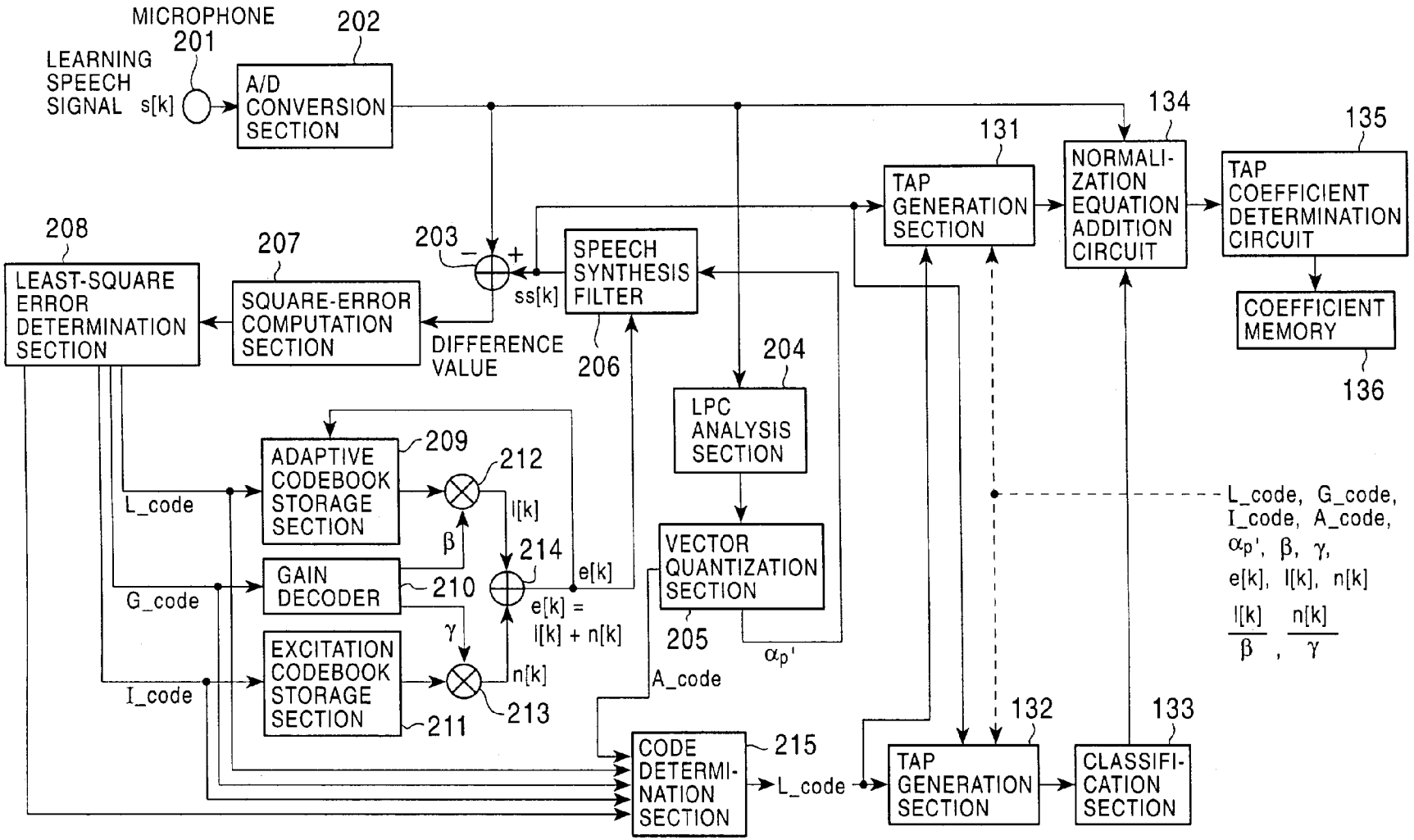
FIG. 9 is a block diagram showing an example of the configuration of a first embodiment of a learning apparatus according to the present invention.

Next, FIG. 9 shows an example of the configuration of a learning apparatus for performing a process of learning tap coefficients which are stored in the coefficient memory 124 of FIG. 5.

Figure 1:
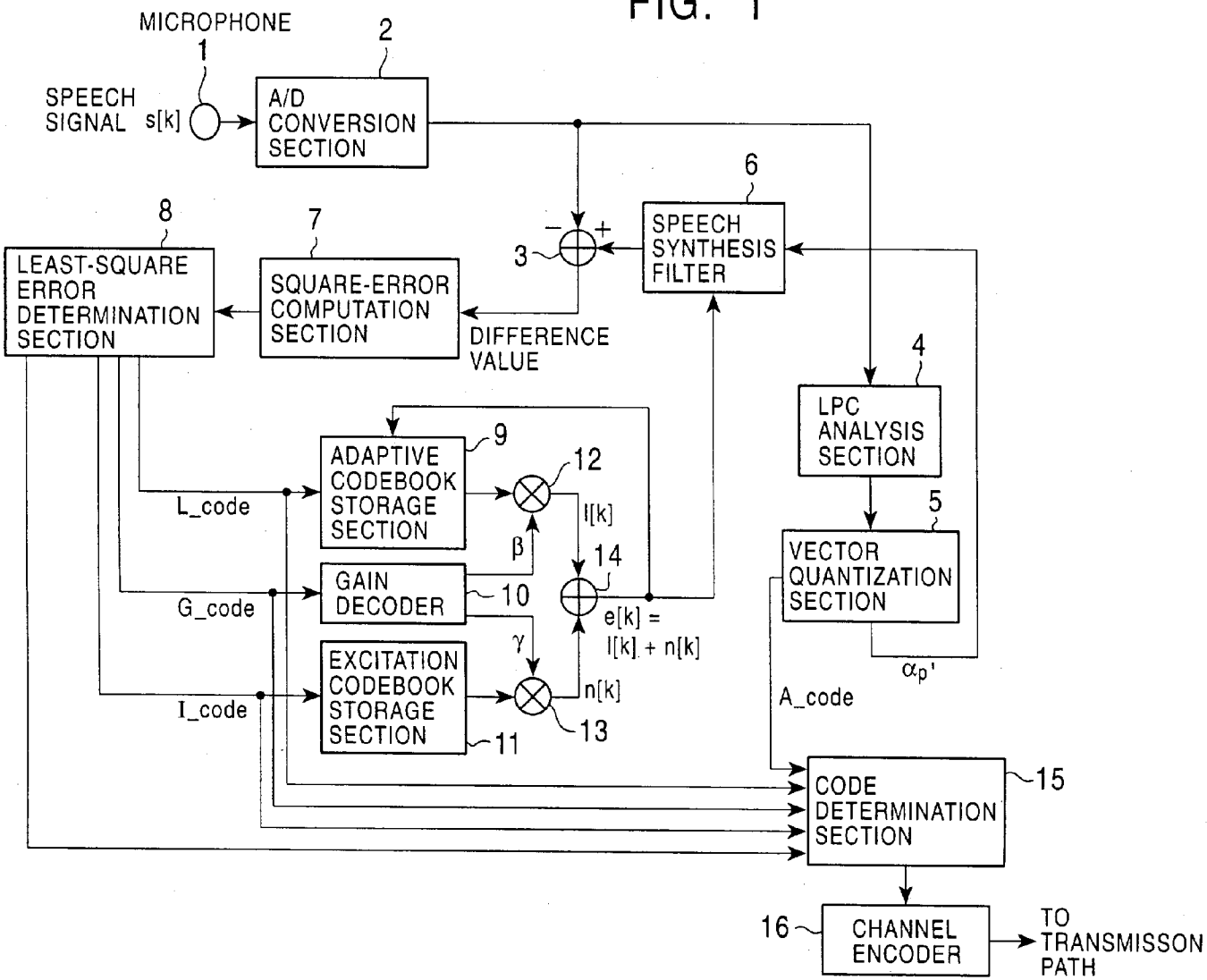
FIG. 1 is a block diagram showing the configuration of an example of a transmission section of a conventional mobile phone.

A series of components from a microphone 201 to a code determination section 215 are formed similarly to the surfaces of components from the microphone 1 to the code determination section 15 of FIG. 1, respectively. A learning speech signal is input to the microphone 1, and therefore, in the components from the microphone 201 to the code determination section 215, the same processes as in the case of FIG. 1 are performed on the learning speech signal.

However, the code determination section 215 outputs the L code used to extract synthesized speech data which forms the prediction tap and the class tap in this embodiment from among the L code, the G code, the I code, and the A code.

Then, the synthesized speech data output by the speech synthesis filter 206 when it is determined in the least-square error determination section 208 that the square error reaches a minimum is supplied to tap generation sections 131 and 132. Furthermore, an L code which is output by the code determination section 215 when the code determination section 215 receives a determination signal from the least-square error determination section 208 is also supplied to the tap generation sections 131 and 132. Furthermore, speech data output by an A/D conversion section 202 is supplied as teacher data to a normalization equation addition circuit 134.

The generation section 131 generates, from the synthesized speech data output from the speech synthesis filter 206, the same prediction tap as in the case of the tap generation section 121 of FIG. 5 on the basis of the L code output from the code determination section 215, and supplies the prediction tap as student data to the normalization equation addition circuit 134.

The tap generation section 132 also generates, from the synthesized speech data output from the speech synthesis filter 206, the same class tap as in the case of the tap generation section 122 of FIG. 5 on the basis of the L code output from the code determination section 215, and supplies the class tap to a classification section 133.

The classification section 133 performs the same classification as in the case of the classification section 123 of FIG. 5 on the basis of the class tap from the tap generation section 132, and supplies the resulting class code to the normalization equation addition circuit 134.

The normalization equation addition circuit 134 receives speech data from the A/D conversion section 202 as teacher data, receives the prediction tap from the generation section 131 as student data, and performs addition for each class code from the classification section 133 by using the teacher data and the student data as objects.

More specifically, the normalization equation addition circuit 134 performs, for each class corresponding to the class code supplied from the classification section 133, multiplication of the student data ($x_{in}x_{im}$), which is each component in the matrix A of equation (13), and a computation equivalent to summation (Σ), by using the prediction tap (student data).

Furthermore, the normalization equation addition circuit 134 also performs, for each class corresponding to the class code supplied from the classification section 133, multiplication of the student data and the teacher data ($x_{in}y_i$), which is each component in the vector v of equation (13), and a computation equivalent to summation (Σ), by using the student data and the teacher data.

The normalization equation addition circuit 134 performs the above-described addition by using all the subframes of the speech data for learning supplied thereto as the subject subframes and by using all the speech data of that subject subframe as the subject data. As a result, a normalization equation shown in equation (13) is formulated for each class.

A tap coefficient determination circuit 135 determines the tap coefficient for each class by solving the normalization equation generated for each class in the normalization equation addition circuit 134, and supplies the tap coefficient to the address corresponding to each class in the coefficient memory 136.

Depending on the speech signal prepared as a learning speech signal, in the normalization equation addition circuit 134, a class may occur at which normalization equations of a number required to determine the tap coefficient are not obtained. For such a class, the tap coefficient determination circuit 135 outputs, for example, a default tap coefficient.

The coefficient memory 136 stores the tap coefficient for each class supplied from the tap coefficient determination circuit 135 at an address corresponding to that class.

Figure 10:
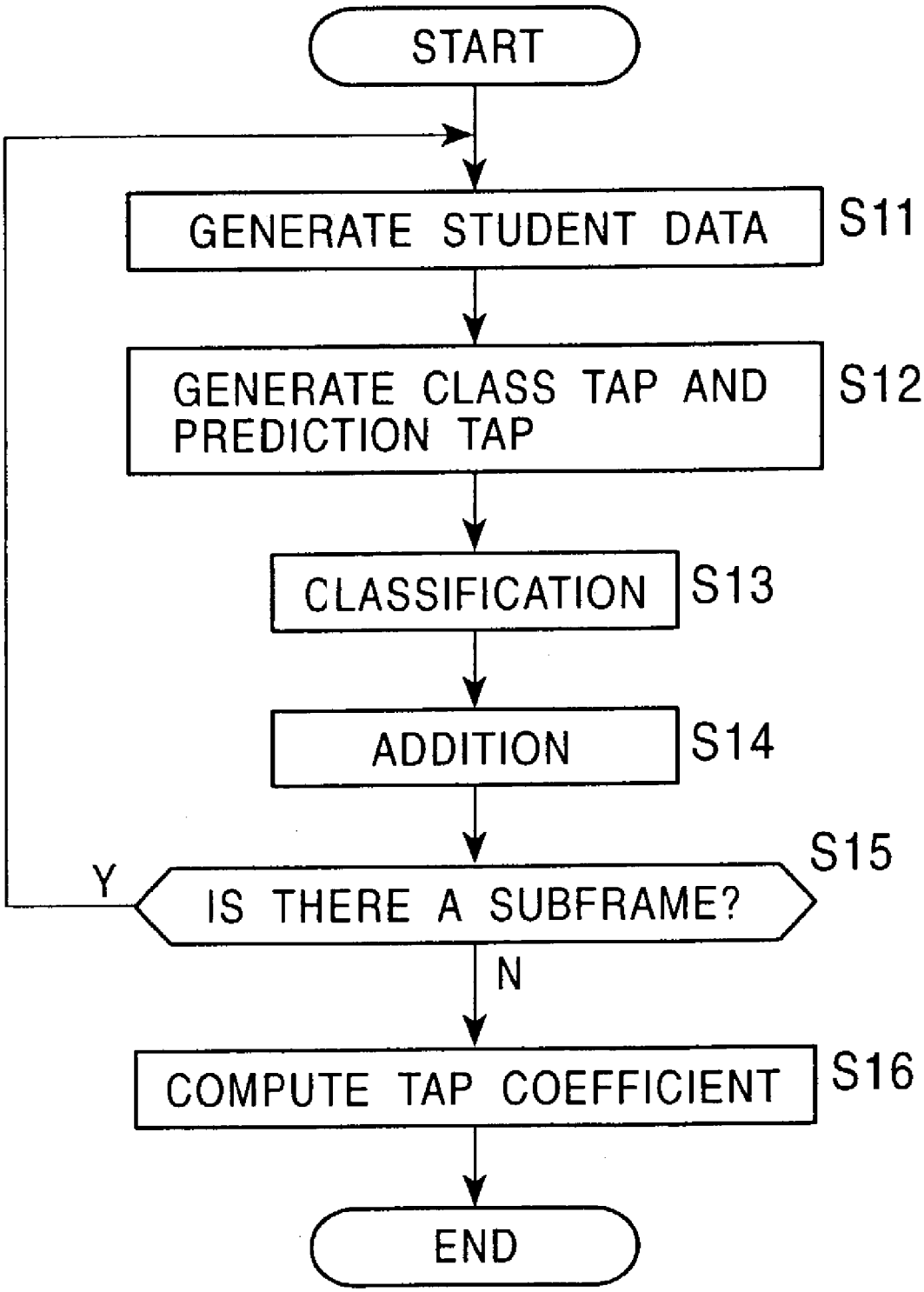
FIG. 10 is a flowchart illustrating processes of the learning apparatus of FIG. 9.

Next, referring to the flowchart in FIG. 10, a description is given of a learning process of determining a tap coefficient for decoding high-quality sound, performed in the learning apparatus of FIG. 9.

A learning speech signal is supplied to the learning apparatus. In step S11, teacher data and student data are generated from the learning speech signal.

More specifically, the learning speech signal is input to the microphone 201, and the components from the microphone 201 to the code determination section 215 perform the same processes as in the case of the components from the microphone 1 to the code determination section 15 in FIG. 1, respectively.

As a result, the speech data of the digital signal obtained by the A/D conversion section 202 is supplied as teacher data to the normalization equation addition circuit 134. Furthermore, when it is determined in the least-square error determination section 208 that the square error reaches a minimum, the synthesized speech data output from the speech synthesis filter 206 is supplied as student data to the tap generation sections 131 and 132. Furthermore, the L code output from the code determination section 215 when it is determined in the least-square error determination section 208 that the square error reaches a minimum is also supplied as student data to the tap generation sections 131 and 132.

Thereafter, the process proceeds to step S12, where the tap generation section 131 assumes, as the subject subframe, the subframe of the synthesized speech supplied as student data from the speech synthesis filter 206, and further assumes the synthesized speech data of that subject subframe in sequence as the subject data, uses the synthesized speech data from the speech synthesis filter 206 with respect to each piece of subject data, generates a prediction tap in a manner similar to the case in the tap generation section 121 of FIG. 5 on the basis of the L code from the code determination section 215, and supplies the prediction tap to the normalization equation addition circuit 134. Furthermore, in step S12, the tap generation section 132 also uses the synthesized speech data in order to generate a class tap on the basis of the L code in a manner similar to the case in the tap generation section 122 of FIG. 5, and supplies the class tap to the classification section 133.

After the process of step S12, the process proceeds to step S13, where the classification section 133 performs classification on the basis of the class tap from the tap generation section 132, and supplies the resulting class code to the normalization equation addition circuit 134.

Then, the process proceeds to step S14, where the normalization equation addition circuit 134 performs addition of the matrix A and the vector v of equation (13), such as that described above, for each class code with respect to the subject data, from the classification section 133, by using as objects the learning speech data, which is high-quality speech data as teacher data from the A/D conversion section 202, that corresponds to the subject data, and the prediction tap as the student data from the tap generation section 132. Then, the process proceeds to step S15.

In step S15, it is determined whether or not there are any more subframes to be processed as subject subframes. When it is determined in step S15 that there are still subframes to be processed as subject subframes, the process returns to step S11, where the next subframe is newly assumed to be the subject subframe, and thereafter, the same processes are repeated.

Furthermore, when it is determined in step S15 that there are no more subframes to be processed as subject subframes, the process proceeds to step S16, where the tap coefficient determination circuit 135 solves the normalization equation created for each class in the normalization equation addition circuit 134 in order to determine the tap coefficient for each class, supplies the tap coefficient to the address corresponding to each class in the coefficient memory 136, whereby the tap coefficient is stored, and the processing is then terminated.

In the above-described manner, the tap coefficient for each class stored in the coefficient memory 136 is stored in the coefficient memory 124 of FIG. 5.

In the manner described above, since the tap coefficient stored in the coefficient memory 124 of FIG. 5 is determined in such a way that learning is performed so that the prediction error (square error) of a speech prediction value of high sound quality, obtained by performing a linear prediction computation, statistically becomes a minimum, the speech output by the prediction section 125 of FIG. 5 becomes high-quality sound.

For example, in the embodiment of FIGS. 5 and 9, the prediction tap and the class tap are formed from synthesized speech data output from the speech synthesis filter 206. However, as indicated by the dotted lines in FIGS. 5 and 9, the prediction tap and the class tap can be formed so as to contain one or more of the I code, the L code, the G code, the A code, a linear prediction coefficient $\alpha_p$ obtained from the A code, a gain β or γ obtained from the G code, and other information (for example, a residual signal e, 1 or n for obtaining the residual signal e, and also, 1/β, n/γ, etc.) obtained from the L code, the G code, the I code, or the A code. Furthermore, in the CELP method, there is a case in which list interpolation bits, frame energy, etc., are contained in code data as coded data. In this case, the prediction tap and the class tap can also be formed so as to contain soft interpolation bits, frame energy, etc.

Figure 11:
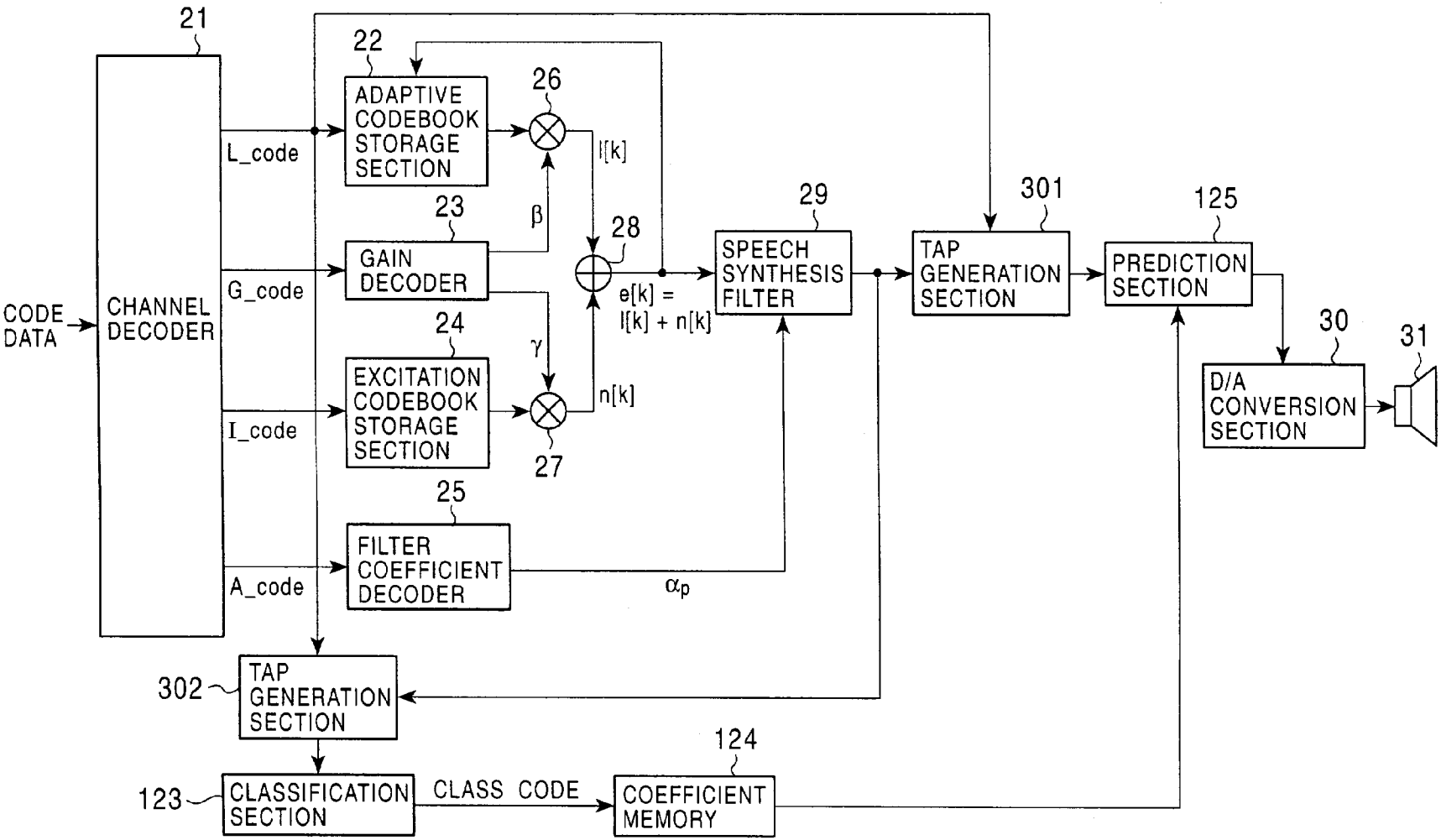
FIG. 11 is a block diagram showing an example of a second configuration of the receiving section 114 according to the present invention.

Next, FIG. 11 shows a second configuration example of the receiving section 114 of FIG. 4. Components in FIG. 11 corresponding to those in the case of FIG. 5 are given the same reference numerals, and in the following, descriptions thereof are omitted where appropriate. That is, the receiving section 114 of FIG. 11 is formed similarly to the case of FIG.

5 except that tap generation sections 301 and 302 are provided instead of the tap generation sections 121 and 122, respectively.

In the embodiment of FIG. 5, in the tap generation sections 121 and 122 (the same applies in the tap generation sections 131 and 132 of FIG. 9), the prediction tap and the class tap are formed of one or both of the lag-compensating past data and the lag-compensating future in addition to the synthesized speech data for 40 samples in the subject subframe. However, it is not particularly controlled whether only the lag-compensating past data, the lag-compensating future data, or one of them should be contained in the prediction tap and the class tap. Therefore, it is necessary to determine in advance which one should be contained so that this is fixed.

Figure 12A:
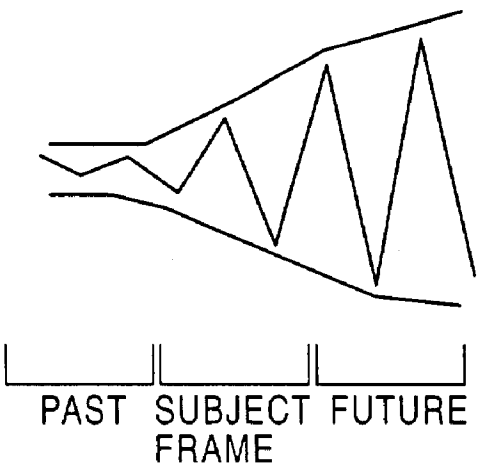
FIGS. 12A to 12C show the progress of a waveform of synthesized speech data.
Figure 12B:
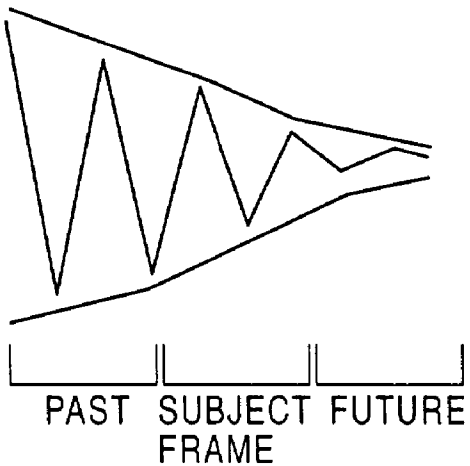

However, in a case where a frame containing a subject subframe (hereinafter referred to as a "subject frame" where appropriate) corresponds to the start time of speech production, it is considered that, as shown in FIG. 12A, the frame in the past with respect to the subject frame is in a silent state (a state equal to only noise being present). Similarly, in a case where a subject subframe corresponds to the end time of speech production, it is considered that, as shown in FIG. 12B, the frame in the future with respect to the subject frame is in a soundless state. Even if such a soundless portion is contained in the prediction tap and the class tap, this hardly contributes to improved sound quality, and rather, in the worst case, this might prevent improved sound quality.

Figure 12C:
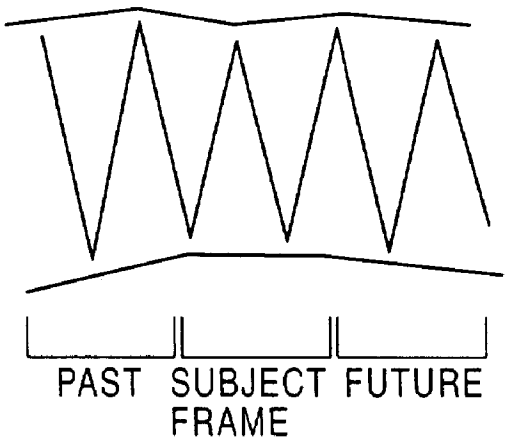

On the other hand, when the subject frame corresponds to a state in which steady-state speech production other than at the start time and the end time of speech production is being performed, as shown in FIG. 12C, it is considered that synthesized speech data corresponding to steady-state speech exists both in the past and for the future with respect to the subject frame. In such a case, it is considered that, by containing both of the lag-compensating past data and the lag-compensating future data, rather than one of them, in the prediction tap and the class tap, the sound quality can be improved still further.

Therefore, the tap generation sections 301 and 302 of FIG. 11 determine which one of those shown in FIGS. 12A to 12C the progress of the waveform of the synthesized speech data is, and generate a prediction tap and a class tap, respectively, on the basis of the determined result.

Figure 13:
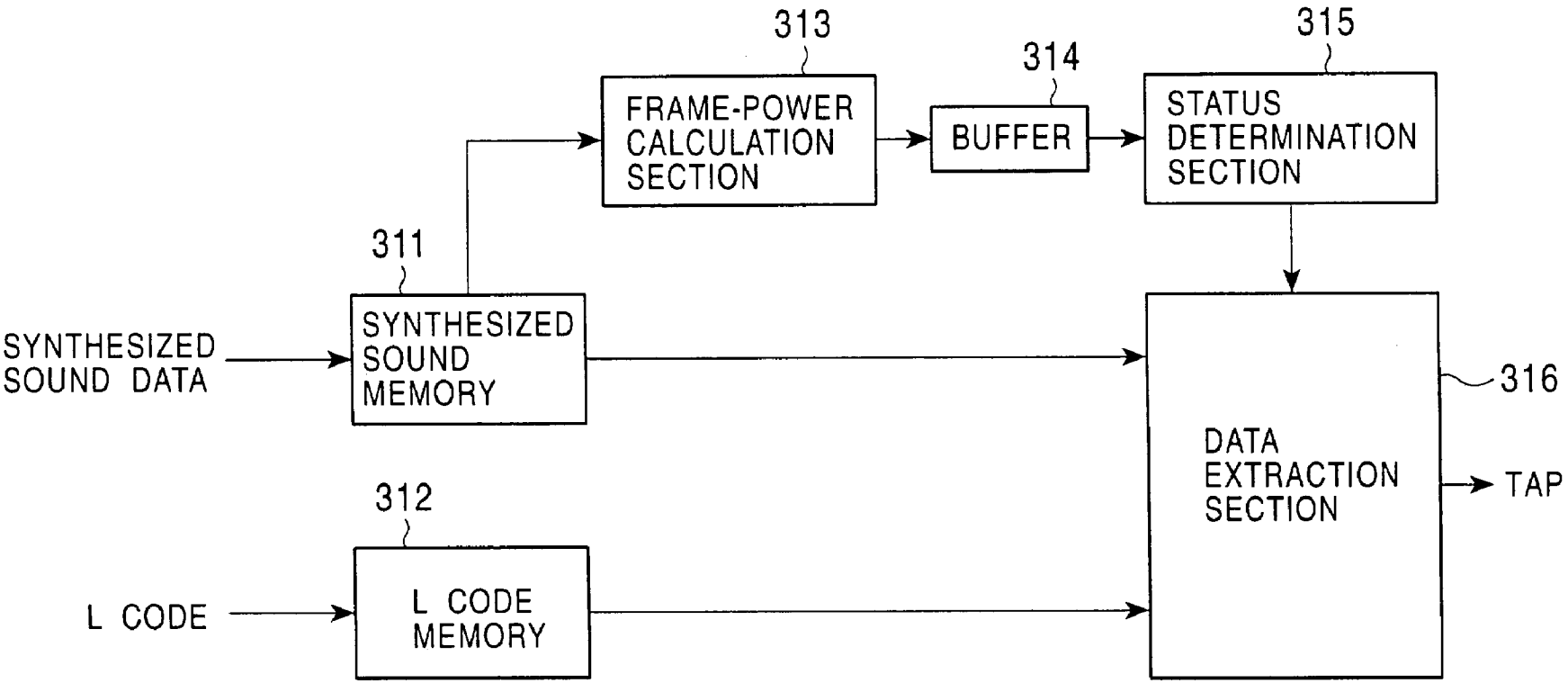
FIG. 13 is a block diagram showing an example of the configuration of tap generation sections 301 and 302.

That is, FIG. 13 shows an example of the configuration of the tap generation section 301 of FIG. 11.

Synthesized speech data output from the speech synthesis filter 29 (FIG. 11) is supplied in sequence to a synthesized speech memory 311, and the synthesized speech memory 311 stores the synthesized speech data in sequence. The synthesized speech memory 311 has at least a storage capacity capable of storing the synthesized speech data from the sample farthest in the past up to the sample farthest in the future within the synthesized speech data which may be assumed to be a prediction tap with respect to synthesized speech data which is assumed to be subject data. Furthermore, when the synthesized speech data corresponding to that amount of storage capacity is stored, the synthesized speech memory 311 stores the synthesized speech data which is supplied next in such a manner as to be overwritten on the oldest stored value.

An L code in subframe units output from the channel decoder 21 (FIG. 11) is supplied in sequence to an L code memory 312, and the L code memory 312 stores the L code in sequence. The L code memory 312 stores the synthesized speech data in sequence. The L code memory 312 has at least a storage capacity capable of storing the L codes from the subject frame in which the sample farthest in the past is located up to the subject frame in which the sample farthest in the future is located within the synthesized speech data which may be assumed to be a prediction tap with respect to the synthesized speech data which is assumed to be subject data. Furthermore, when L codes corresponding to that amount of storage capacity are stored, the L code memory 312 stores the L code which is supplied next in such a manner as to be overwritten on the oldest stored value.

A frame-power calculation section 313 determines the power of the synthesized speech data in that frame in predetermined frame units by using the synthesized speech data stored in the synthesized speech memory 311, and supplies the power to a buffer 314. The frame which is a unit at which the power is determined by the frame-power calculation section 313 may match the frame and the subframe in the CELP method or may not match. Therefore, the frame which is a unit at which the power is determined by the frame-power calculation section 313 may be formed by a value, for example, 128 samples other than the 160 samples which form the frame or the 40 samples which form the subframe in the CELP method. However, in this embodiment, for the simplicity of description, it is assumed that the frame which is a unit at which the power is determined by the frame-power calculation section 313 matches the frame in the CELP method.

The buffer 314 stores the power of the synthesized speech data supplied from the frame-power calculation section 313 in sequence. The buffer 314 is capable of storing the power of the synthesized speech data for at least a total of three frames of the subject frame and the frames immediately before and after the subject frame. Furthermore, when the power corresponding to that amount of storage capacity is stored, the buffer 314 stores the power which is supplied next from the frame-power calculation section 313 in such a manner as to be overwritten in the oldest stored value.

A status determination section 315 determines the progress of the waveform of the synthesized speech data in the vicinity of the subject data on the basis of the power stored in the buffer 314. That is, the status determination section 315 determines which one of the following states the progress of the waveform of the synthesized speech data in the vicinity of the subject data has become: a state in which, as shown in FIG. 12A, the frame immediately before the subject frame is in a soundless state (hereinafter referred to as a "rising state" as appropriate), a state in which, as shown in FIG. 12B, the frame immediately after the subject frame is in a soundless state (hereinafter referred to as a "falling state" as appropriate); and a state in which, as shown in FIG. 12C, a steady state is reached from immediately before the subject frame to immediately after the subject frame (hereinafter referred to as a "steady state" as appropriate). Then, the status determination section 315 supplies the determined result to a data extraction section 316.

The data extraction section 316 reads the synthesized speech data of the subject subframe from the synthesized speech memory 311 so as to extracted. Furthermore, the data extraction section 316 reads, based on the determined result of the progress of the waveform from the status determination section 315, one or both of the lag-compensating past data and the lag-compensating future data from the synthesized speech memory 311 by referring to the L code memory 312 so as to extracted. Then, the data extraction section 316 outputs, as the prediction tap, the synthesized speech data of the subject subframe, read from the synthesized speech memory 311, and one or both of the lag-compensating past data and the lag-compensating future data read from the synthesized speech memory 311.

Figure 14:
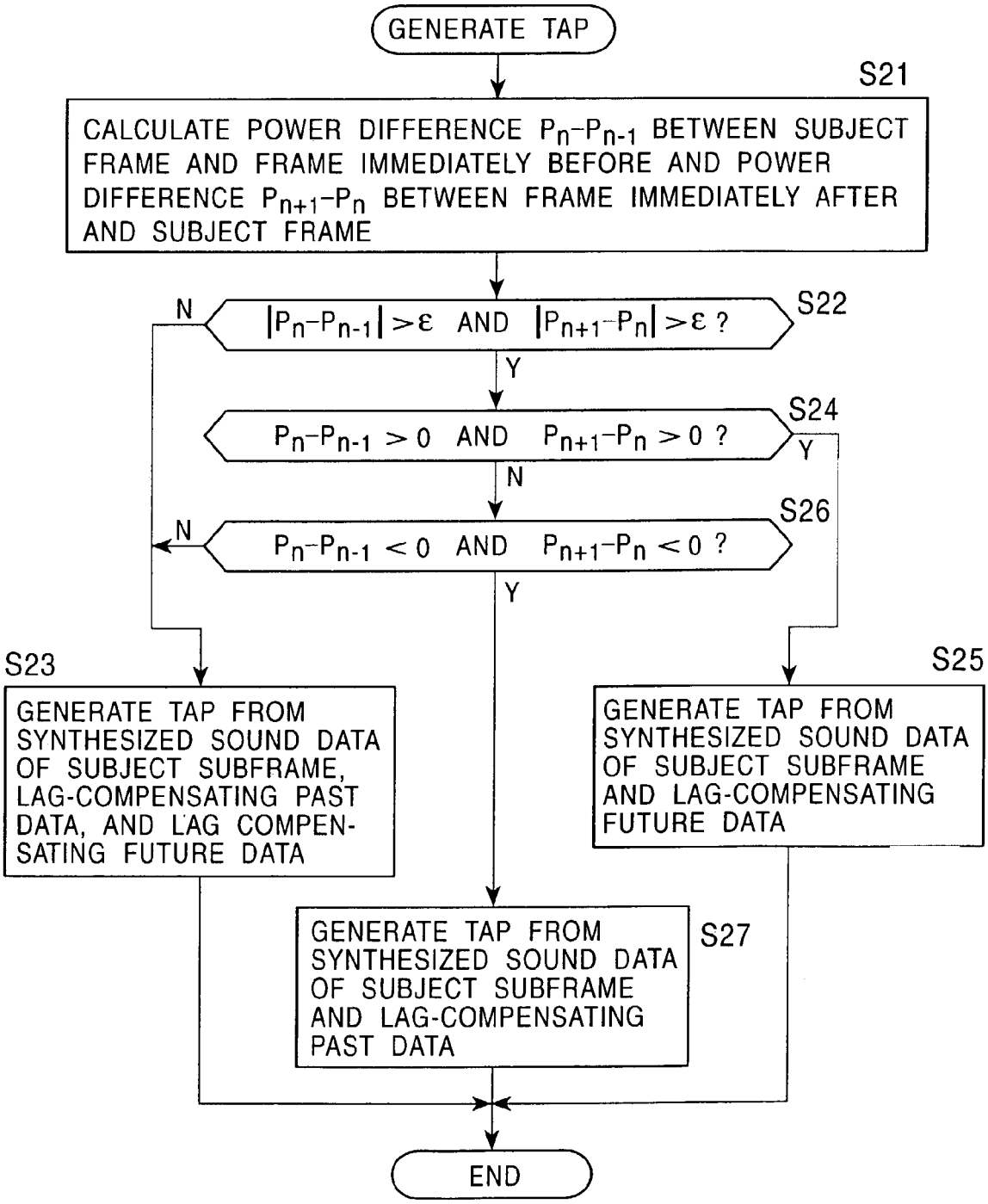
FIG. 14 is a flowchart illustrating processes of the tap generation sections 301 and 302.

Next, referring to the flowchart FIG. 14, the process of the tap generation section 301 of FIG. 13 is described.

Synthesized speech data output from the speech synthesis filter 29 (FIG. 11) is supplied to the synthesized speech memory 311 in sequence, and the synthesized speech memory 311 stores the synthesized speech data in sequence. Furthermore, L codes in subframe units, output from the channel decoder 21 (FIG. 11), are supplied to the L code memory 312 in sequence, and the L code memory 312 stores the L codes in sequence.

Meanwhile, the frame-power calculation section 313 reads the synthesized speech data stored in the synthesized speech memory 311 in frame units in sequence, determines the power of the synthesized speech data in each frame, and stores the power in the buffer 314.

Then, in step S21, the status determination section 315 reads, from the buffer 314, the power $P_n$ of the subject frame, the power $P_{n-1}$ of the frame immediately before the subject subframe, and the power $P_{n+1}$ of the frame immediately after the subject subframe. The status determination section 315 calculates the difference value $P_n$-$P_{n-1}$ between the power $P_n$ of the subject frame and the power $P_{n-1}$ of the frame immediately before that, and the difference value $P_{n+1}-P_n$ between the power $P_{n+1}$ of the frame immediately after the subject frame and the power $P_n$ of the subject frame, and the process proceeds to step S22.

In step S22, the status determination section 315 determines whether or not both the absolute value of the difference value $P_n-P_{n-1}$ and the absolute value of the difference value $P_{n+1}-P_n$ are greater than (equal to or greater than) a predetermined threshold value $\epsilon$.

When it is determined in step S22 that at least one of the absolute value of the difference value $P_n$-$P_{n-1}$ and the absolute value of the difference value $P_{n+1}$-$P_n$ is not greater than the predetermined threshold value $\epsilon$, the status determination section 315 determines that the progress of, as shown in FIG. 12C in the vicinity of the subject data has reached a steady state in which, as shown in FIG. 12C, it is in a steady state from immediately before the subject frame to immediately after the subject frame, supplies a "steady state" message indicating that fact to the data extraction section 316, and the process proceeds to step S23.

In step S23, when the data extraction section 316 receives the "steady state" message from the status determination section 315, the data extraction section 316 reads the synthesized speech data of the subject subframe from the synthesized speech memory 311 and further reads the synthesized speech data as the lag-compensating past data and the lag-compensating future data by referring to the L code memory 312. Then, the data extraction section 316 outputs the synthesized speech data as the prediction computation, and the processing is then terminated.

When it is determined in step S22 that both the absolute value of the difference value $P_n-P_{n-1}$ and the absolute value of the difference value $P_{n+1}-P_n$ are greater than the predetermined threshold value $\epsilon$, the process proceeds to step S24, where the status determination section 315 determines whether or not both the difference value $P_n-P_{n-1}$ and the difference value $P_{n+1}-P_n$ are positive. When it is determined in step S24 that both the difference value $P_n-P_{n-1}$ and the difference value $P_{n+1}-P_n$ are positive, the status determination section 315 determines that, as shown in FIG. 12A, the progress of the waveform of the synthesized speech data in the vicinity of the subject data has reached a rising state in which the frame immediately before the subject frame is in a soundless state, supplies a "rising state" message indicating that fact to the data extraction section 316, and the process proceeds to step S25.

In step S25, when the "rising state" message is received from the status determination section 315, the data extraction section 316 reads the synthesized speech data of the subject subframe from the synthesized speech memory 311, and further reads the synthesized speech data as the lag-compensating future data by referring to the L code memory 312. Then, the data extraction section 316 outputs the synthesized speech data as the prediction tap, and the processing is then terminated.

On the other hand, when it is determined in step S24 that at least one of the difference value $P_n-P_{n-1}$ and the difference value $P_{n+1}-P_n$ is not positive, the process proceeds to step S26, where the status determination section 315 determines whether or not both the difference value $P_n-P_{n-1}$ and the difference value $P_{n+1}-P_n$ are negative. When it is determined in step S26 that at least one of the difference value $P_n-P_{n-1}$ and the difference value $P_{n+1}-P_n$ is not negative, the status determination section 315 determines that the progress of the waveform of the synthesized speech data in the vicinity of the subject data has reached a steady state, and supplies a "steady state" message indicating that fact to the data extraction section 316, and the process proceeds to step S23.

In step S23, in the manner described above, the data extraction section 316 reads, from the synthesized speech memory 311, the synthesized speech data of the subject subframe, the lag-compensating past data, and the lag-compensating future data, outputs these as the prediction tap, and the processing is then terminated.

When it is determined in step S26 that both the difference value $P_n-P_{n-1}$ and the difference value $P_{n+1}-P_n$ are negative, the status determination section 315 determines that the progress of the waveform of the synthesized speech data in the vicinity of the subject data has reached a "falling state" in which, as shown in FIG. 12B, the frame immediately after the subject frame is in a soundless state, supplies the "falling state" message indicating that fact to the data extraction section 316, and the process proceeds to step S27.

In step S27, when the "falling state" message is received from the status determination section 315, the data extraction section 316 reads the synthesized speech data of the subject subframe from the synthesized speech memory 311, and further reads the synthesized speech data as the lag-compensating past data by referring to the L code memory 312. Then, the data extraction section 316 outputs the synthesized speech data as the prediction tap, and the processing is then terminated.

The tap generation section 302 of FIG. 11 can also be formed similarly to the tap generation section 301 shown in FIG. 13. In this case, as described with reference to FIG. 14, a class tap can be formed. However, in FIG. 13, the synthesized speech memory 311, the L code memory 312, the frame-power calculation section 313, the buffer 314, and the status determination section 315 can be shared between the tap generation sections 301 and 302.

Furthermore, in the above-described cases, the power in the subject frame is compared with the power in each of the frames immediately before and after that in order to determine the progress of the waveform of the synthesized speech data in the vicinity of the subject data. In addition, the determination of the progress of the waveform of the synthesized speech data in the vicinity of the subject data can also be performed by comparing the power in the subject frame with the power in frames further in the past and further for the future.

In addition, in the above-described cases, the progress of the waveform of the synthesized speech data in the vicinity of the subject data is determined to be one of the three states, that is, the "steady state", the "falling state", and the "rising state". However, the progress may be determined to be one of four or more states. That is, for example, in FIG. 14, in step S22, each of the absolute value of the difference value $P_n-P_{n-1}$ and the absolute value of the difference value $P_{n+1}-P_n$ is compared with one threshold value $\epsilon$ so as to the determine the magnitude relationship. However, by comparing the absolute value of the difference value $P_n-P_{n-1}$ and the absolute value of the difference value $P_{n+1}-P_n$ with a plurality of threshold values, it is possible to determine the progress of the waveform of the synthesized speech data in the vicinity of the subject data to be one of four or more states.

In a case where, in this manner, the progress of the waveform of the synthesized speech data in the vicinity of the subject data is determined to be one of four or more states, the prediction tap can be formed so as to contain, in addition to the synthesized speech data of the subject subframe and the lag-compensating past data and the lag-compensating future data, for example, the synthesized speech data which becomes lag-compensating past data or lag-compensating future data when the lag-compensating past data or the lag-compensating future data is used as subject data.

In the tap generation section 301, when the prediction tap is to be generated in the above-described manner, the number of samples of the synthesized speech data which form the prediction tap varies. This fact applies the same to the class tap which is generated in the tap generation section 302.

For the prediction tap, even if the number of data items (the number of taps) which form the prediction tap varies, no problem is posed because the same number of tap coefficients as the number of prediction taps need only be learned in the learning apparatus of FIG. 16, which will be described later, and need only be stored in the coefficient memory 124.

On the other hand, for the class tap, if the number of taps which form the class tap varies, the number of all the classes obtained for each class tap of each number of taps varies, presenting the risk that the processing becomes complex. Therefore, it is preferable that classification in which, even if the number of taps of the class tap varies, the number of classes obtained by the class tap does not vary be performed.

As a method of performing classification in which, even if the number of taps of the class tap varies, the number of classes obtained by the class tap does not vary, there is a method in which, for example, the structure of the class tap is taken into consideration in classification.

More specifically, in this embodiment, as a result of the class tap being formed to contain one or both of the lag-compensating past data and the lag-compensating future data in addition to the synthesized speech data of the subject subframe, the number of taps of the class tap increases or decreases. Therefore, for example, in a case where the class tap is formed of the synthesized speech data of the subject subframe, and one of the lag-compensating past data and the lag-compensating future data, the number of taps is assumed to be S, and in a case where the class tap is formed of the synthesized speech data of the subject subframe and both of the lag-compensating past data and the lag-compensating future data, the number of taps is assumed to be L (>S). Then, it is assumed that, when the number of taps is S, a class code of n bits is obtained, and when the number of taps is L, a class code of n+m bits is obtained.

In this case, as the class code, n+m+2 bits are used, and, for example, the two high-order bits within the n+m+2 bits are set to, for example, "00", "01", or "10" depending on whether the class tap contains lag-compensating past data, the class tap contains lag-compensating future data, or the class tap contains both, respectively. As a result, even if the number of taps is either S or L, classification in which the total number of classes is $2^{n+m+2}$ becomes possible.

More specifically, when the class tap contains both the lag-compensating past data and the lag-compensating future data and the number of taps is L, classification in which a class code of n+m bits is obtained need only be performed, and also, n+m+2 bits such that "10" indicating that the class tap contains both the lag-compensating past data and the lag-compensating future data is added to the class code of the n+m bits as the high-order 2 bits thereof need only be assumed to be the final class.

Furthermore, when the class tap contains lag-compensating past data and the number of taps thereof is S, classification in which a class code of n bits is obtained need only be performed, and "0" of m bits need only be added as the high-order bits of the class code of the n bits so as to be formed as n+m bits, and n+m+2 bits such that "00" indicating that the class tap contains the lag-compensating past data is added to the n+m bits as the high-order bits need only be assumed to be the final class code.

In addition, when the class tap contains the lag-compensating future data and the number of taps is S, classification in which a class code of n bits is obtained need only be performed, that "0" of m bits is added to the class code of the n bits as the higher-order bits thereof so as to be formed as n+m bits, and n+m+2 bits such that "01" indicating that the class tap contains the lag-compensating future data is added to the n+m bits as the high-order bits need only be assumed to be the final class code.

Next, in the tap generation section 301 of FIG. 13, power in frame units is calculated from the synthesized speech data in the frame-power calculation section 313. However, there is a case where, as described above, frame energy is contained in the coded data (code data) in which speech is coded by the CELP method. In this case, the frame energy may be adopted as the power of the synthesized speech in that frame.

Figure 15:
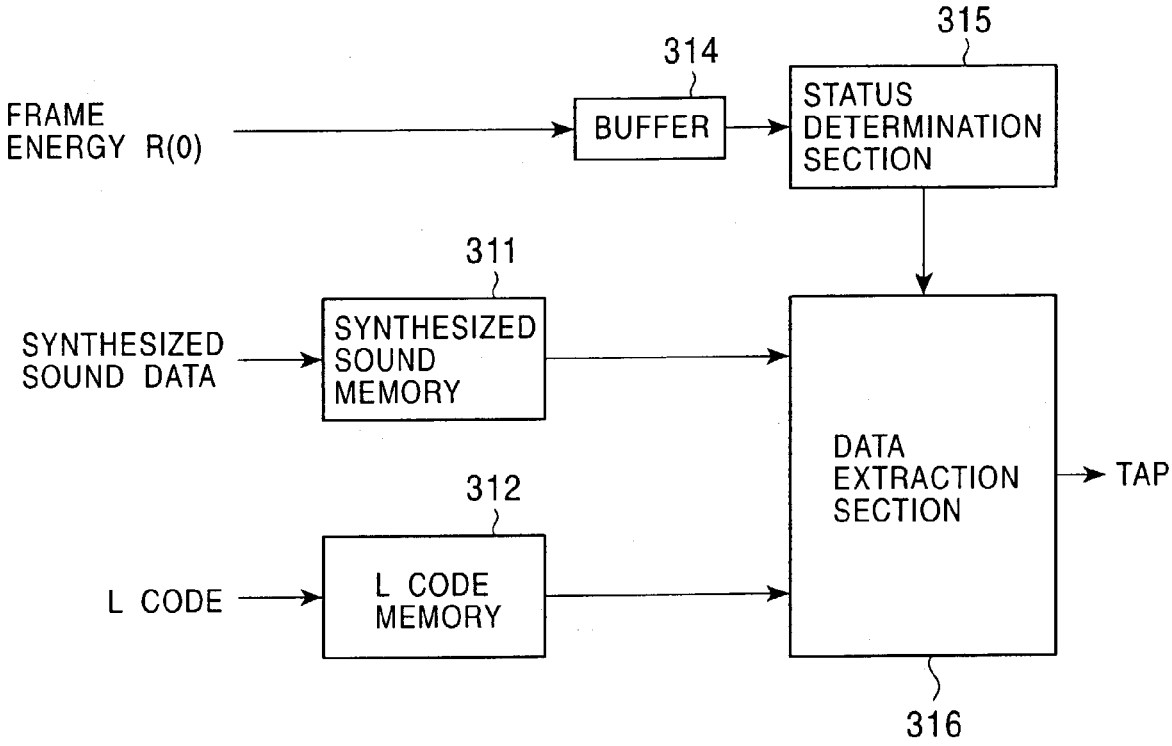
FIG. 15 is a block diagram showing another example of the configuration of the tap generation sections 301 and 302.

FIG. 15 shows an example of the configuration of the tap generation section 301 of FIG. 11 in a case where frame energy is adopted as the power of the synthesized speech in that frame. Components in FIG. 15 corresponding to those in the case of FIG. 13 are given the same reference numerals. That is, the tap generation section 301 of FIG. 15 is formed similarly to the case of FIG. 13 except that a frame-power calculation section 313 is not provided.

Frame energy for each frame, contained in the coded data (code data) supplied to the receiving section 114 (FIG. 11), is supplied to the buffer 314, and the buffer 314 stores this frame energy. Then, the status determination section 315 determines the progress of the waveform of the synthesized speech data in the vicinity of the subject data by using this frame energy in a manner similar to the above-described power in frame units determined from the synthesized speech data.

Here, the frame energy for each frame, contained in the coded data, is separated from the coded data in the channel encoder 21, and is supplied to the tap generation section 301.

The tap generation section 302 can also be formed as shown in FIG. 15.

Figure 16:
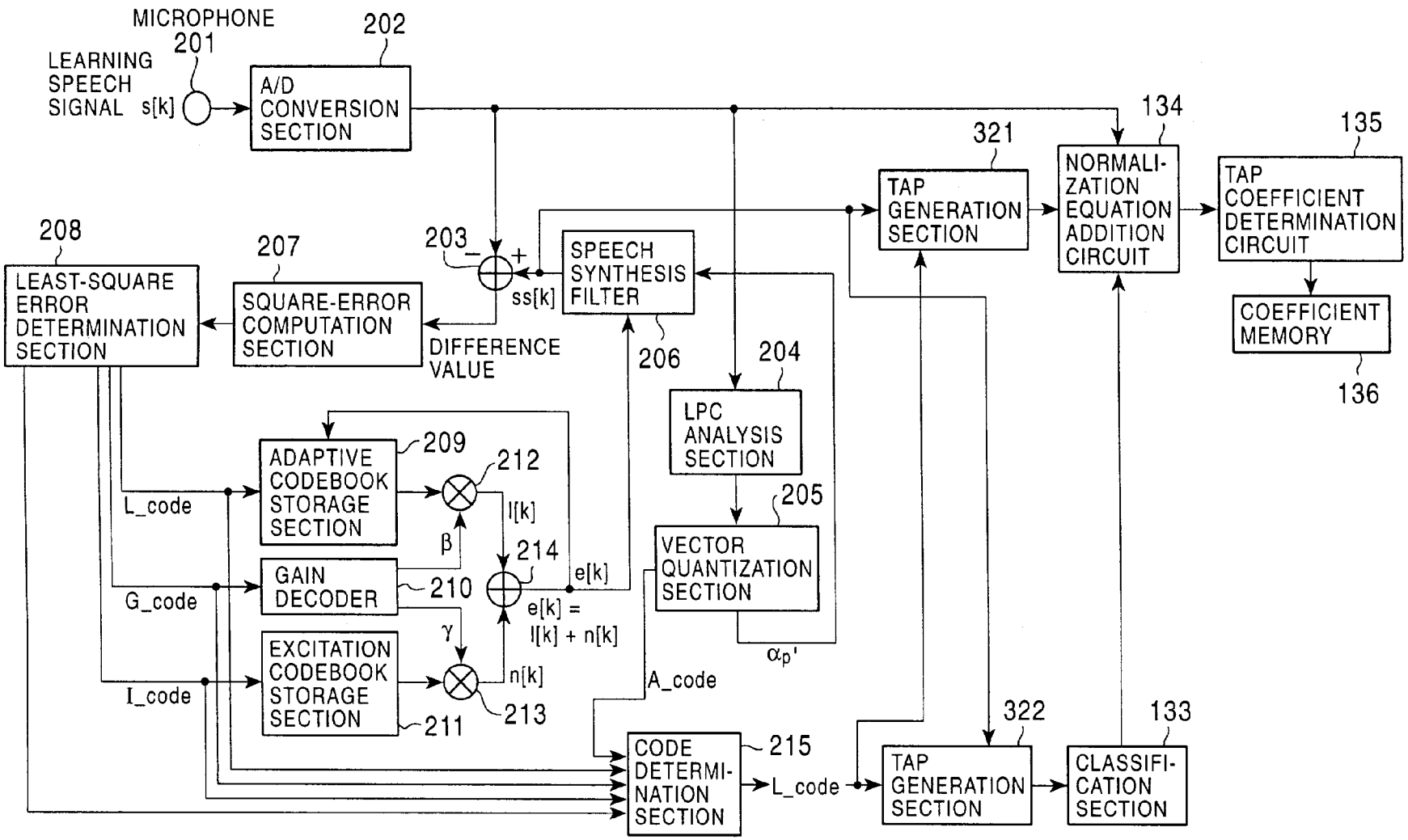
FIG. 16 is a block diagram showing an example of the configuration of a second embodiment of a learning apparatus according to the present invention.

Next, FIG. 16 shows an example of the configuration of an embodiment of a learning apparatus for learning a tap coefficient stored in the coefficient memory 124 of the receiving section 114 when the receiving section 114 is formed as shown in FIG. 11. Components in FIG. 16 corresponding to those in the case of FIG. 9 are given the same reference numerals, and descriptions thereof are omitted where appropriate. That is, the learning apparatus of FIG. 16 is formed similarly to the case of FIG. 9 except that, instead of the tap generation sections 131 and 132, tap generation sections 321 and 322 are provided, respectively.

The tap generation sections 321 and 322 form a prediction tap and a class tap in the same manner as in the case of the tap generation sections 301 and 302 of FIG. 11, respectively.

Therefore, in this case, a tap coefficient with which higher-quality sound can be decoded can be obtained.

In the learning apparatus, in a case where a prediction tap and a class tap are to be generated, when determination of the progress of the waveform of the synthesized speech data in the vicinity of subject data is made by using frame energy for each frame as described with reference to FIG. 15, the frame energy can be calculated by using a self-correlation coefficient obtained in the process of LPC analysis in the LPC analysis section 204.

Figure 17:
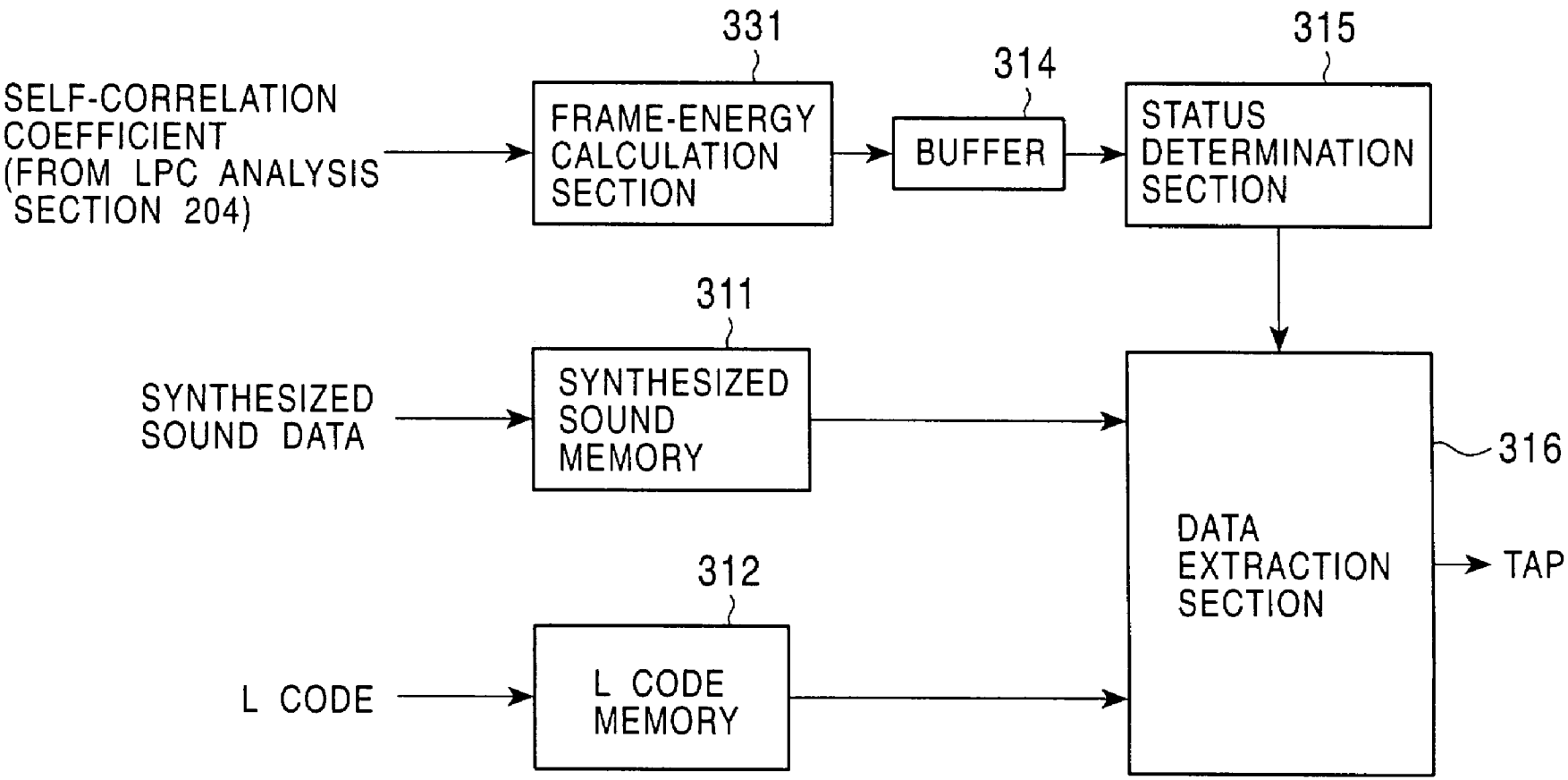
FIG. 17 is a block diagram showing an example of the configuration of tap generation sections 321 and 322.

Therefore, FIG. 17 shows an example of the configuration of the tap generation section 321 of FIG. 16 in a case where frame energy is determined from a self-correlation coefficient. Components in FIG. 17 corresponding to those in the case of the tap generation section 301 of FIG. 13 are given the same reference numerals, and in the following, descriptions thereof are omitted where appropriate. That is, the tap generation section 321 of FIG. 17 is formed similarly to the tap generation section 301 in FIG. 13 except that, instead of the frame-power calculation section 313, a frame-energy calculation section 331 is provided.

A self-correlation coefficient of speech determined in the process in which LPC analysis is performed by the LPC analysis section 204 of FIG. 16 is supplied to the frame-energy calculation section 331. The frame-energy calculation section 331 calculates the frame energy contained in the coded data (code data) on the basis of the self-correlation coefficient, and supplies the frame energy to the buffer 314.

Therefore, in the embodiment of FIG. 17, the status determination section 315 determines the progress of the waveform of the synthesized speech data in the vicinity of subject data by using this frame energy in the same manner as the above-described power in frame units determined from the synthesized speech data.

The tap generation section 322 of FIG. 16 for generating a class tap can also be formed as shown in FIG. 17.

Figure 18:
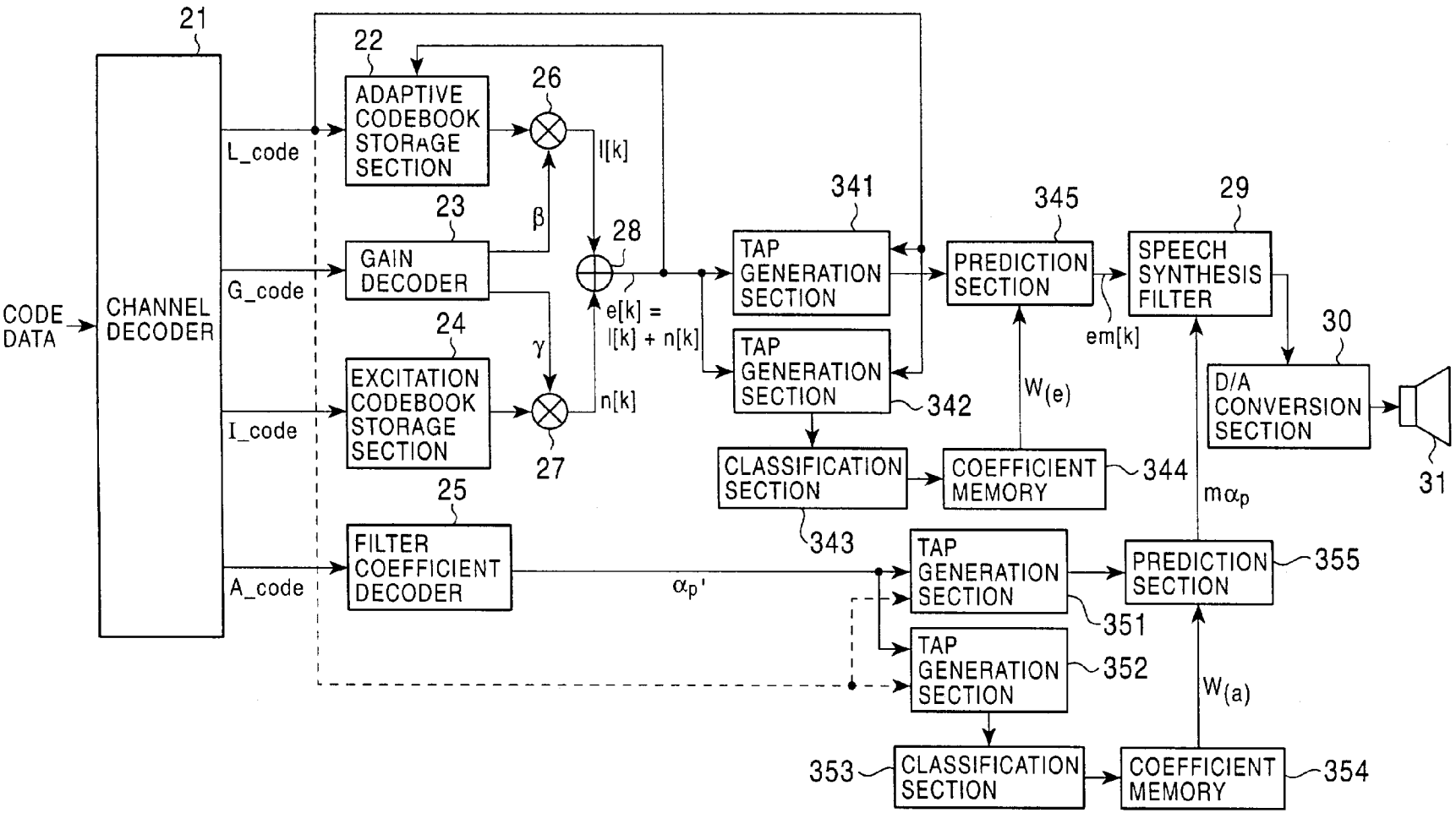
FIG. 18 is a block diagram showing an example of a third configuration of the receiving section 114.

Next, FIG. 18 shows an example of a third configuration of the receiving section 114 of FIG. 4. Components in FIG. 18 corresponding to those in the case of FIG. 5 or 11 are given the same reference numerals, and descriptions thereof are omitted where appropriate.

The receiving section 114 of FIG. 5 or 11 decodes highs quality sound by performing a classification and adaptation process on the synthesized speech data output from the speech synthesis filter 29. However, the receiving section 114 of FIG. 18 decodes high-quality sound by performing a classification and adaptation process on a residual signal (decoded residual signal) input to the speech synthesis filter 29 and a linear prediction coefficient (decoded linear prediction coefficient).

More specifically, in the adaptive codebook storage section 22, the gain decoder 23, the excitation codebook storage section 24, and the arithmetic units 26 to 28, a decoded residual signal which is a residual signal decoded from an L code, a G code, and an I code, and a decoded linear prediction coefficient which is a linear prediction coefficient decoded from an A code in the filter coefficient decoder 25 contain an error in the manner described above. If these are directly input to the speech synthesis filter 29, the sound quality of the synthesized speech data output from the speech synthesis filter 29 deteriorates.

Therefore, in the receiving section 114 of FIG. 18, by performing prediction computation using the tap coefficient determined by learning, the prediction values of the true residual signal and the true linear prediction coefficient are determined, and these values are provided to the speech synthesis filter 29 in order to generate high-quality synthesized speech.

More specifically, in the receiving section 114 of FIG. 18, for example, by using a classification and adaptation process, the decoded residual signal is decoded into (the prediction value of) the true residual signal, the decoded linear prediction coefficient is decoded into (the prediction value of) the true linear prediction coefficient, and the residual signal and the linear prediction coefficient are provided to the speech synthesis filter 29, allowing high-quality synthesized speech data to be determined.

Therefore, the decoded residual signal output from the arithmetic unit 28 is supplied to tap generation sections 341 and 32. Furthermore, the L code output from the channel decoder 21 is also supplied to the tap generation sections 341 and 342.

Then, similarly to the tap generation section 121 of FIG. 5 and the tap generation section 301 of FIG. 11, the tap generation section 341 extracts, from the decoded residual signal supplied thereto, a sample which is used as a prediction tap on the basis of the L code, and supplies the sample to a prediction section 345.

Also, the tap generation section 342 extracts a sample which is used as a class tap from the decoded residual signal supplied thereto in a manner similar to the tap generation section 122 of FIG. 5 and the tap generation section 302 of FIG. 11 on the basis of the L code, and supplies the sample to a classification section 343.

The classification section 343 performs classification on the basis of the class tap supplied from the tap generation section 342, and supplies the class code as the classification result to a coefficient memory 344.

The coefficient memory 344 stores a tap coefficient $w_{(e)}$ for the residual signal for each class, obtained as a result of a learning process being performed in the learning apparatus of FIG. 21 (to be described later), and supplies the tap coefficient stored at the address corresponding to the class code output from the classification section 343 to the prediction section 345.

The prediction section 345 obtains the prediction tap output from the tap generation section 341 and the tap coefficient for the residual signal, output from the coefficient memory 344, and performs linear prediction computation shown in equation (6) by using the prediction tap and the tap coefficient. As a result, the prediction section 345 determines (the prediction value em of) the residual signal of the subject subframe and supplies it as an input signal to the speech synthesis filter 29.

A decoded linear prediction coefficient $\alpha_p'$ for each subframe, output from the filter coefficient decoder 25, is supplied to tap generation sections 351 and 352. The tap generation sections 351 and 352 extract, from the decoded linear prediction coefficients, those used as a prediction tap and the class tap, respectively. Here, for example, the tap generation sections 351 and 352 assume all the linear prediction coefficients of the subject subframe to be the prediction taps and the class taps, respectively. The prediction tap is supplied from the tap generation section 351 to the prediction section 355, and the class tap is supplied from the tap generation section 352 to the classification section 353.

The classification section 353 performs classification on the basis of the class tap supplied from the tap generation section 352, and supplies the class code as the classification result to a coefficient memory 354.

The coefficient memory 354 stores a tap coefficient $w_{(a)}$ for the linear prediction coefficient for each class, obtained as a result of a learning process being performed in the learning apparatus of FIG. 21, which will be described later. The coefficient memory 354 supplies the tap coefficient stored at the address corresponding to the class code output from the classification section 353 to a prediction section 355.

The prediction section 355 obtains the prediction tap output from the tap generation section 351 and the tap coefficient for the linear prediction coefficient output from the coefficient memory 354, and performs linear prediction computation shown in equation (6) by using the prediction tap and the tap coefficient. As a result, the prediction section 355 determines (the prediction value $m\alpha_p$ of) a linear prediction coefficient of the subject subframe, and supplies it to the speech synthesis filter 29.

Figure 19:
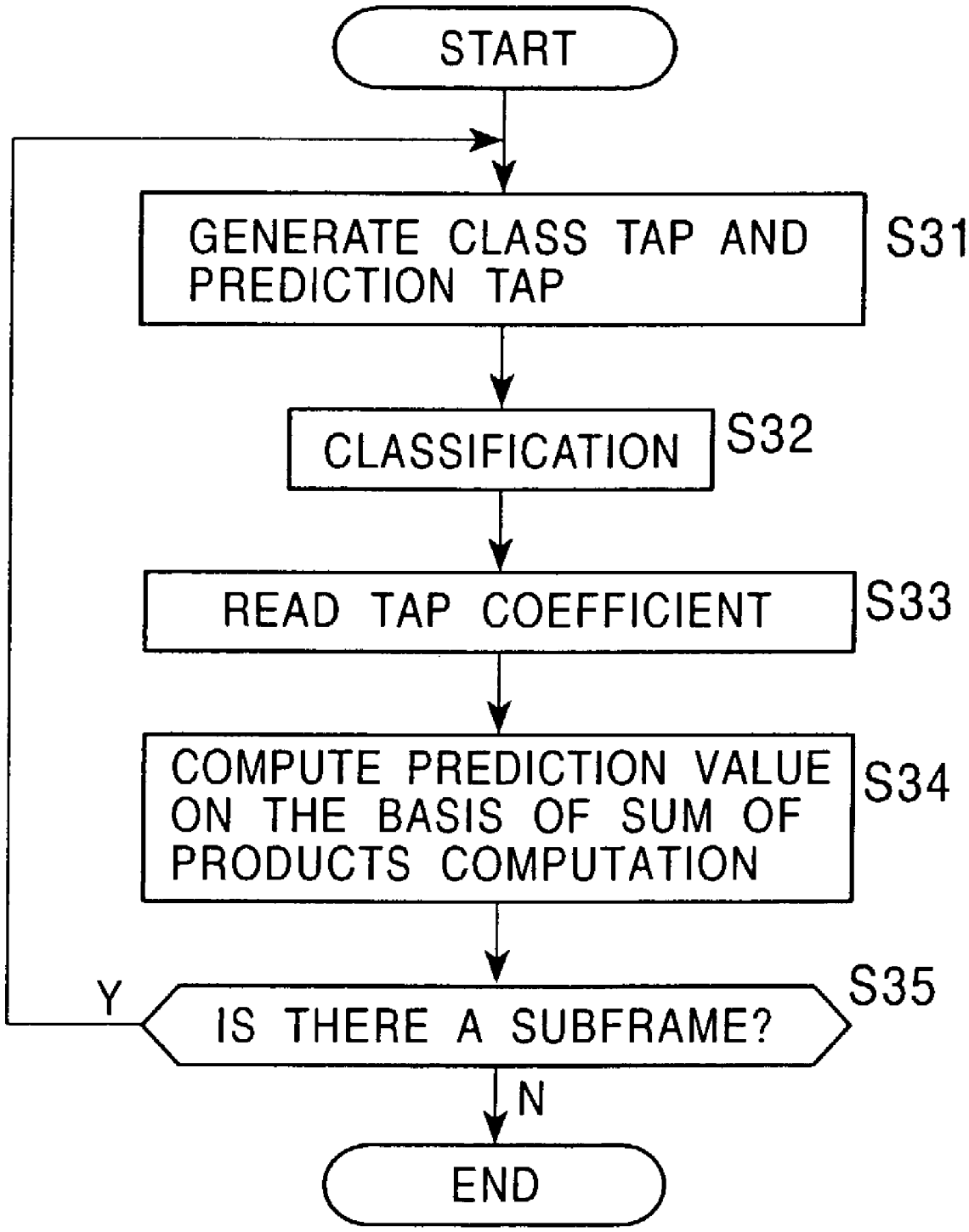
FIG. 19 is a flowchart illustrating processes of the receiving section 114 of FIG. 18.

Next, referring to the flowchart in FIG. 19, the process of the receiving section 114 of FIG. 18 is described.

The channel decoder 21 separates an L code, a G code, an I code, and an A code from the code data supplied thereto, and supplies the codes to the adaptive codebook storage section 22, the gain decoder 23, the excitation codebook storage section 24, and the filter coefficient decoder 25, respectively. Furthermore, the L code is also supplied to the tap generation sections 341 and 342.

Then, in the adaptive codebook storage section 22, the gain decoder 23, the excitation codebook storage section 24, and the arithmetic units 26 to 28, the processes which are the same as in the case of the adaptive codebook storage section 9, the gain decoder 10, the excitation codebook storage section 11, and the arithmetic units 12 to 14 are performed, and as a result, the L code, the G code, and the I code are decoded into a residual signal e. This decoded residual signal is supplied from the arithmetic unit 28 to the tap generation sections 341 and 342.

Furthermore, as described in FIG. 2, the filter coefficient decoder 25 decodes the A code supplied thereto into a decoded linear prediction coefficient and supplies it to the tap generation sections 351 and 352.

Then, in step S31, the prediction tap and the class tap are generated.

More specifically, the tap generation section 341 assumes the subframe of the decoded residual signal supplied thereto to be a subject subframe in sequence and assumes the sample value of the decoded residual signal of the subject subframe to be subject data in sequence in order to extract the decoded residual signal in the subject subframe, and extracts the decoded residual signal of other than the subject subframe on the basis of the L code located in the subject subframe, output from the channel decoder 21, That is, the tap generation section 341 extracts a decoded residual signal for 40 samples, in which a position in the past by the amount of lag indicated by the L code located in the subject subframe (this will hereinafter be referred to as a "lag-compensating past data" where appropriate) is a starting point or a decoded residual signal for 40 samples located in a subframe which is future when seen from the subject subframe (this will hereinafter be referred to as a "lag-compensating future data" where appropriate), in which an L code such that a position in the past by the amount of the lag indicated by the L code is a position of the subject data is located, and generates a class tap. The tap generation section 342 also generates a class tap in the same manner as the tap generation section 341.

Furthermore, in step S31, the tap generation sections 351 and 352 extract the decoded linear prediction coefficient of the subject subframe, output from a filter coefficient decoder 35 as the prediction tap and the class tap, respectively.

Then, the prediction tap obtained by the tap generation section 341 is supplied to the prediction section 345. The class tap obtained by the tap generation section 342 is supplied to the classification section 343. The prediction tap obtained by the tap generation section 351 is supplied to the prediction section 355. The class tap obtained by the tap generation section 352 is supplied to the classification section 353.

Then, the process proceeds to step S32, where the classification section 343 performs classification on the basis of the class tap supplied from the tap generation section 342, and supplies the resulting class code to the coefficient memory 344. The classification section 353 performs classification on the basis of the class tap supplied from the tap generation section 352, and supplies the resulting class code to the coefficient memory 354, and the process proceeds to step S33.

In step S33, the coefficient memory 344 reads the tap coefficient for the residual signal from the address corresponding to the class code supplied from the classification section 343 and supplies the tap coefficient to the prediction section 345. Furthermore, the coefficient memory 354 reads the tap coefficient for the linear prediction coefficient from the address corresponding to the class code supplied from the classification section 343, and supplies the tap coefficient to the prediction section 355.

Then, the process proceeds to step S34, where the prediction section 345 obtains the tap coefficient for the residual signal output from the coefficient memory 344, and performs a sum-of-products computation shown in equation (6) by using the tap coefficient and the prediction tap from the tap generation section 341 in order to obtain (the prediction value of) the true residual signal of the subject subframe. Furthermore, in step S34, the prediction section 355 obtains the tap coefficient for the linear prediction coefficient output from the coefficient memory 344, and performs a sum-of-products computation shown in equation (6) by using the tap coefficient and the prediction tap from the tap generation section 351 in order to obtain (the prediction value of) the true linear prediction coefficient of the subject subframe.

The residual signal and the linear prediction coefficient obtained in the above-described manner are supplied to the speech synthesis filter 29. In the speech synthesis filter 29, as a result of the computation of equation (4) being performed by using the residual signal and the linear prediction coefficient, synthesized speech data corresponding to the subject data of the subject subframe is generated. This synthesized speech data is supplied from the speech synthesis filter 29 via the D/A conversion section 30 to the speaker 31, whereby synthesized speech corresponding to the synthesized speech data is output from the speaker 31.

In the prediction sections 345 and 355, after the residual signal and the linear prediction coefficient are obtained, respectively, the process proceeds to step S35, where it is determined whether or not there is still an L code, a G code, an I code, and an A code of the subframe to be processed as the subject subframe. When it is determined in step S35 that there is still an L code, a G code, an I code, and an A code of the subframe to be processed as the subject subframe, the process returns to step S31, where the subframe to be used next as the subframe is newly used as a subject subframe, and hereafter, the same processes are repeated. When it is determined in step S35 that there is not an L code, a G code, an I code, or an A code of the subframe to be processed as the subject subframe, the processing is terminated.

Next, in the tap generation section 341 of FIG. 18 (the same applies to the tap generation section 342 for generating a class tap), the prediction tap is formed of a decoded residual signal of the subject subframe, and one or both of the lag-compensating past data and the lag-compensating future data. Although the construction can be fixed, the construction may be variable based on the progress of the waveform of the residual signal.

Figure 20:
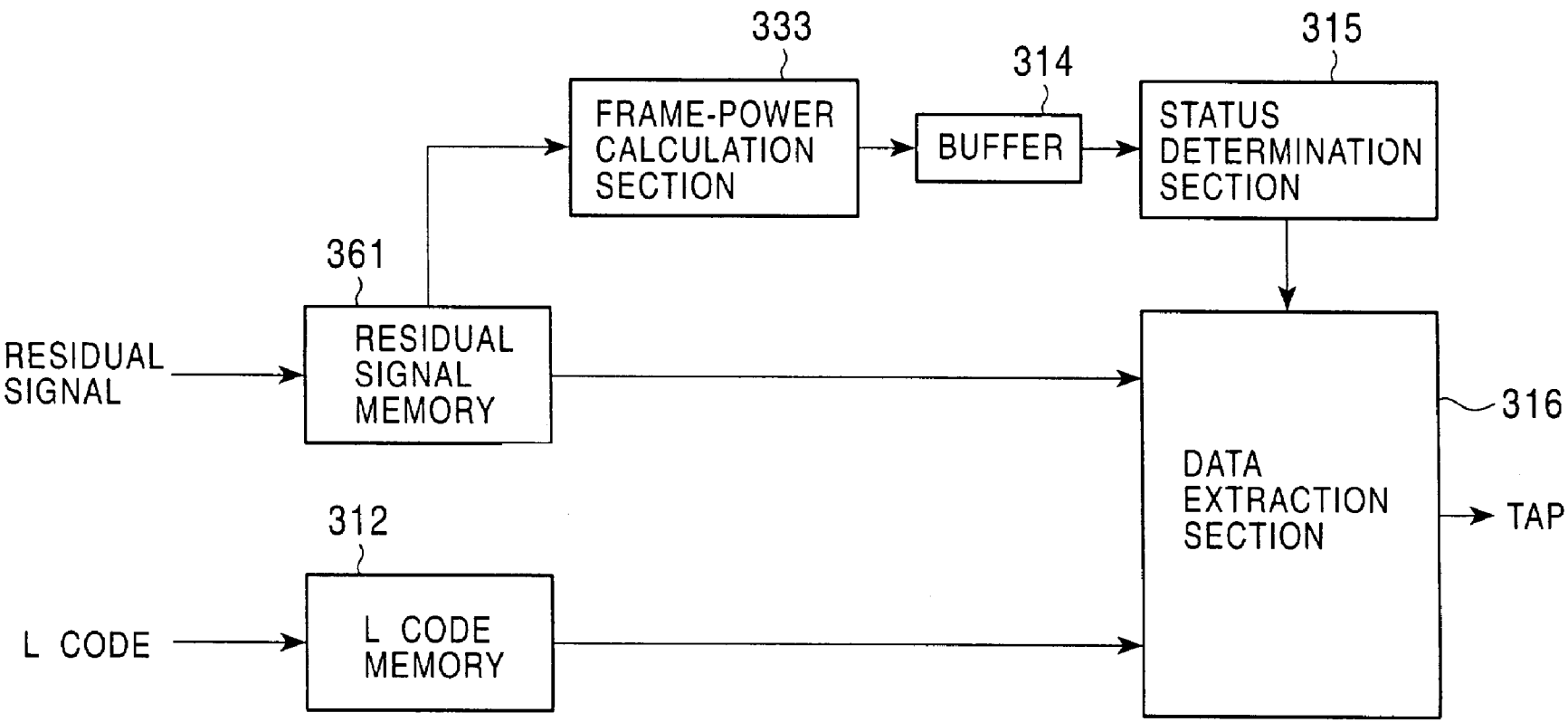
FIG. 20 is a block diagram showing an example of the configuration of tap generation sections 341 and 342.

FIG. 20 shows an example of the configuration of the tap generation section 341 in a case where the structure of the prediction tap is variable on the basis of the progress of the waveform of a residual signal. Components in FIG. 20 corresponding to those in the case of FIG. 13 are given the same reference numerals, and in the following, descriptions thereof are omitted where appropriate. That is, the tap generation section 341 of FIG. 20 is formed similarly to the tap generation section 301 of FIG. 13 except that, instead of the synthesized speech memory 311 and the frame-power calculation section 313, a residual signal memory 361 and a frame-power calculation section 363 are provided.

The decoded residual signal output from the arithmetic unit 28 (FIG. 18) is supplied to the residual signal memory 361 in sequence, and the residual signal memory 361 stores the decoded residual signal in sequence. The residual signal memory 361 has at least the storage capacity capable of storing the decoded residual signal from the most past sample to the most future sample among the decoded residual signals which are possibly used as a prediction tap for the subject data. Furthermore, when the decoded residual signals are stored by the amount of the storage capacity, the residual signal memory 361 stores the sample value of the decoded residual signal to be supplied next in such a manner as to be overwritten on the oldest stored value.

The frame-power calculation section 363 determines the power of the residual signal in the frame in predetermined frame units by using the residual signal stored in the residual signal memory 361, and supplies the power to the buffer 314. The frame which is a unit at which the power is determined by the frame-power calculation section 363 may match the frame or the subframe in the CELP method or may not match, in the same manner as in the case of the frame-power calculation section 313 of FIG. 13.

In the tap generation section 341 of FIG. 20, the power of the decoded residual signal rather than the power of the synthesized speech data is determined. Based on that power, it is determined which one of the "rising state", the "falling state", and the "steady state" the progress of the waveform of the residual signal is in, as described in FIG. 12. Then, based on the determined result, in addition to the decoded residual signal of the subject subframe, one or both of the lag-compensating past data and the lag-compensating future data are extracted, and a prediction tap is generated.

The tap generation section 342 of FIG. 18 can also be formed similarly to the tap generation section 341 shown in FIG. 20.

Furthermore, in the embodiment of FIG. 18, with respect to only the decoded residual signal, the prediction tap and the class tap are generated on the basis of the L code. However, also with respect to the decoded linear prediction coefficient, a decoded linear prediction coefficient of other than the subject subframe may be extracted on the basis of the L code, and the prediction tap and the class tap may be generated. In this case, as indicated by the dotted line in FIG. 18, the L code output from the channel decoder 21 may be supplied to the tap generation sections 351 and 352.

Furthermore, in the above-described case, when the prediction tap and the class tap are to be generated from the synthesized speech data, the power of the synthesized speech data is determined, and based on the power, the progress of the waveform of the synthesized speech data is determined. When the prediction tap and the class tap are to be generated from the decoded residual signal, the power of the decoded residual signal is determined, and based on the power, the progress of the waveform of the synthesized speech data is determined. However, the progress of the waveform of the synthesized speech data can be determined on the basis of the power of the residual signal, and similarly, the progress of the waveform of the residual signal can be determined on the basis of the power of the synthesized speech data.

Figure 21:
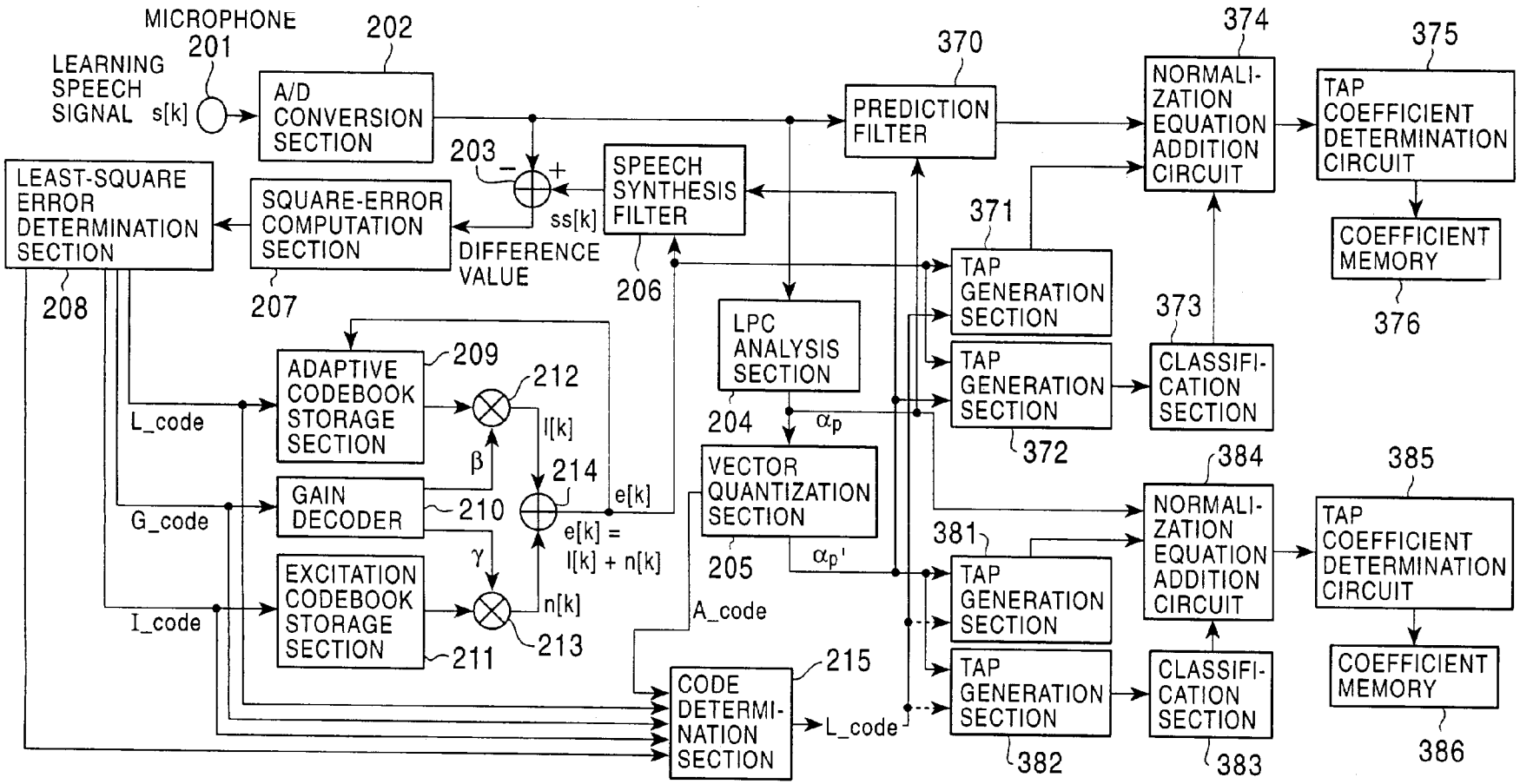
FIG. 21 is a block diagram showing an example of the configuration of a third embodiment of a learning apparatus according to the present invention.

Next, FIG. 21 shows an example of the configuration of an embodiment of a learning apparatus for performing a learning process of tap coefficients to be stored in the coefficient memories 344 and 354 of FIG. 18. Components in FIG. 21 corresponding to those in the case of FIG. 16 are given the same reference numerals, and in the following, descriptions thereof are omitted where appropriate.

A learning speech signal which is converted into a digital signal which is output from the A/D conversion section 202, and a linear prediction coefficient output from the LPC analysis section 204 are supplied to a prediction filter 370. Furthermore, a decoded residual signal output from the arithmetic unit 214 (the same residual signal which is supplied to the speech synthesis filter 206), and an L code output from the code determination section 215 are supplied to tap generation sections 371 and 372. A decoded linear prediction coefficient (a linear prediction coefficient which forms a code vector (centroid vector) of a codebook used for vector quantization) output from the vector quantization section 205 is supplied to tap generation sections 381 and 382. Furthermore, a linear prediction coefficient output from the LPC analysis section 204 is supplied to a normalization equation addition circuit 384.

The prediction filter 370 assumes the subframe of the learning speech signal supplied from the A/D conversion section 202 in sequence to be a subject subframe, and performs a computation based on, for example, equation (1) by using the speech signal of that subject subframe and the linear prediction coefficient supplied from the LPC analysis section 204, thereby determining the residual signal of the subject frame. This residual signal is supplied as teacher data to a normalization equation addition circuit 374.

The tap generation section 371 generates the same prediction tap as in the case of the tap generation section 341 of FIG. 18 on the basis of the L code output from the code determination section 215 by using the decoded residual signal supplied from the arithmetic unit 214, and supplies the prediction tap to the normalization equation addition circuit 374. The tap generation section 372 also generates the same class tap as in the case of the tap generation section 342 of FIG. 18 on the basis of the L code output from the code determination section 215 by using the decoded residual signal supplied from the arithmetic unit 214, and supplies the class tap to the classification section 373.

The classification section 373 performs classification in the same manner as in the case of the classification section 343 of FIG. 18 on the basis of the class tap supplied from the tap generation section 371, and supplies the resulting class code to the normalization equation addition circuit 374.

The normalization equation addition circuit 374 receives, as teacher data, the residual signal of the subject subframe from the prediction filter 370, and receives, as student data, the prediction tap from the tap generation section 371. By using the teacher data and the student data as objects, the normalization equation addition circuit 374 performs addition in the same manner as in the case of the normalization equation addition circuit 134 of FIG. 9 or 16 for each class code from the classification section 373, thereby formulates, for each class, a normalization equation, shown in equation (13), on the residual signal.

The tap-coefficient determination circuit 375 determines the tap coefficient for the residual signal for each class by solving the normalization equation generated for each class in the normalization equation addition circuit 374, and supplies the tap coefficient to the address, corresponding to each class, of the coefficient memory 376.

The coefficient memory 376 stores the tap coefficient for the residual signal for each class, supplied from the tap-coefficient determination circuit 375.

The tap generation section 381 generates the same prediction tap as in the case of the tap generation section 351 of FIG. 18 by using the linear prediction coefficient which is an element of the code vector, that is, the decoded linear prediction coefficient, supplied from the vector quantization section 205, and supplies the prediction tap to the normalization equation addition circuit 384. The tap generation section 382 also generates the same class tap as in the case of the tap generation section 352 of FIG. 18 by using the decoded linear prediction coefficient supplied from the vector quantization section 205, and supplies the class tap to the classification section 383.

In the embodiment of FIG. 18, regarding the decoded linear prediction coefficient, when the decoded linear prediction coefficient of other than the subject subframe is extracted on the basis of the L code so as to generate the prediction tap and the class tap, also, in the tap generation sections 381 and 382 of FIG. 21, similarly, it is necessary to generate the prediction tap and the class tap. In this case, as indicated by the dotted lines in FIG. 21, the L code output from the code determination section 215 is supplied to the tap generation sections 381 and 382.

The classification section 383 performs classification on the basis of the class tap from the tap generation section 382 in the same manner as in the case of the classification section 353 of FIG. 18, and supplies the resulting class code to the normalization equation addition circuit 384.

The normalization equation addition circuit 384 receives, as teacher data, the linear prediction coefficient of the subject subframe from the LPC analysis section 204, receives, as student data, the prediction tap from the tap generation section 381, and performs the same addition as in the case of the normalization equation addition circuit 134 of FIG. 9 or 16 for each class code from the classification section 383 by using the teacher and the student data as objects, thereby formulating a normalization equation, shown in equation (13), on a linear prediction coefficient.

The tap-coefficient determination circuit 385 determines each tap coefficient for the linear prediction coefficient for each class by solving the normalization equation formulated for each class in the normalization equation addition circuit 384, and supplies the tap coefficient to the address, corresponding to each class, of the coefficient memory 386.

The coefficient memory 386 stores the tap coefficient for the linear prediction coefficient for each class, supplied from the tap-coefficient determination circuit 385.

Depending on the speech signal prepared as a learning speech signal, in the normalization equation addition circuits 374 and 384, a class at which normalization equations of a number required to determine the tap coefficient are not obtained may occur. For such a class, the tap coefficient determination circuits 375 and 385 output, for example, a default tap coefficient.

Figure 22:
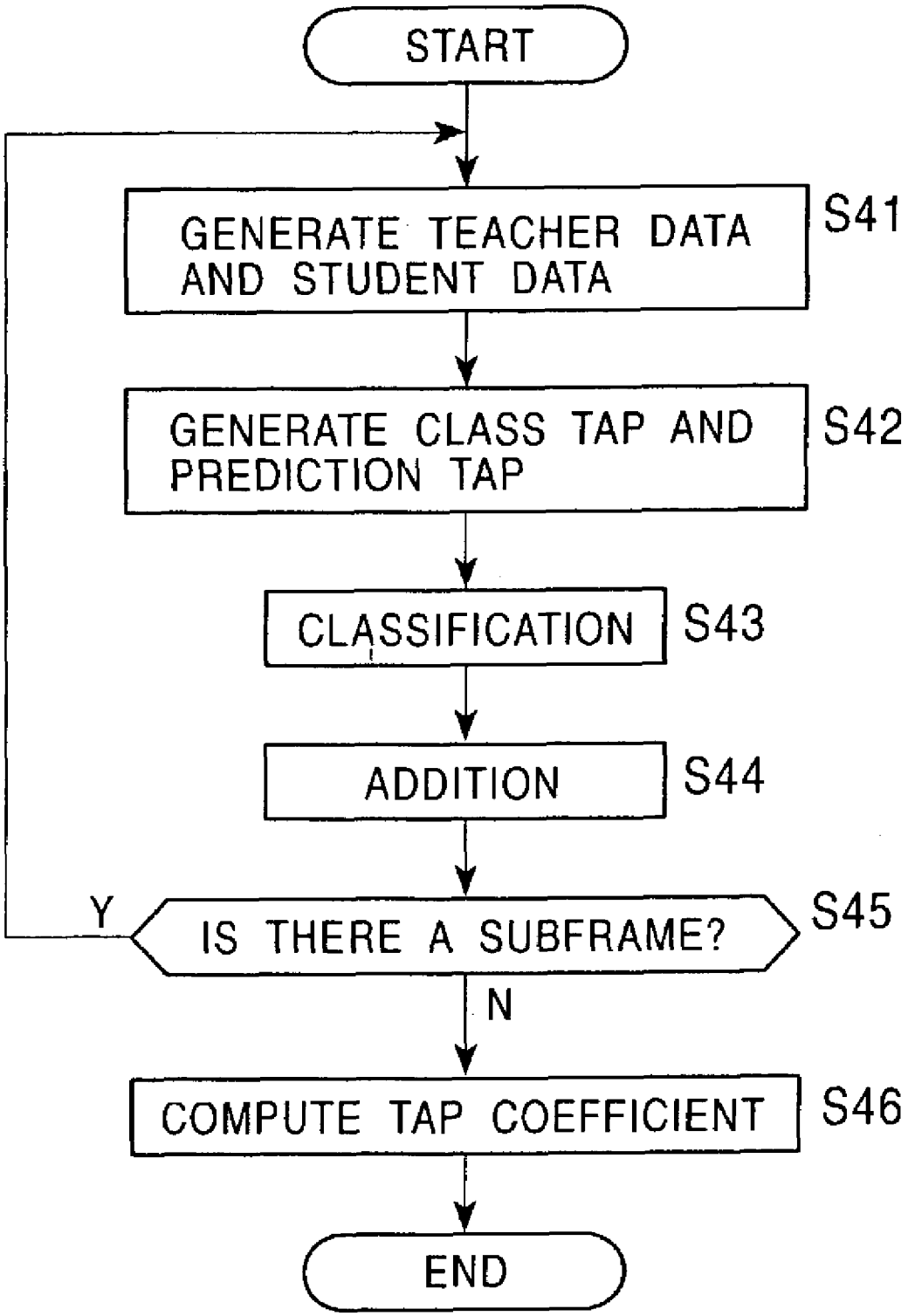
FIG. 22 is a flowchart illustrating processes of the learning apparatus of FIG. 21.

Next, referring to the flowchart in FIG. 22, a description is given of a learning process for determining a tap coefficient for each of a residual signal and a linear prediction coefficient, performed by the learning apparatus of FIG. 21.

A learning speech signal is supplied to the learning apparatus, and in step S41, teacher data and student data are generated from the learning speech signal.

More specifically, the learning speech signal is input to the microphone 201, and a series of the microphone 201 to the code determination section 215 perform the same processes as in the case of a series of the microphone 1 to the code determination section 15 of FIG. 1, respectively.

As a result, the linear prediction coefficient obtained by the LPC analysis section 204 is supplied as teacher data to the normalization equation addition circuit 384. Furthermore, the linear prediction coefficient is also supplied to a prediction filter 370. In addition, the decoded residual signal obtained by an arithmetic unit 214 is supplied as student data to the tap generation sections 371 and 372.

The digital speech signal output from the A/D conversion section 202 is supplied to the prediction filter 370, and the decoded linear prediction coefficient output from the vector quantization section 205 is supplied as student data to the tap generation sections 381 and 382. Furthermore, the code determination section 215 supplies, to the tap generation sections 371 and 372, the L code from the least-square error determination section 208 when the determination signal from the least-square error determination section 208 is received.

Then, the prediction filter 370 determines the residual signal of the subject subframe by performing a computation based on equation (1) by assuming the subframe of the learning speech signal supplied from the A/D conversion section 202 as a subject subframe in sequence and by using the speech signal of that subject subframe and the linear prediction coefficient supplied from the LPC analysis section 204 (the linear prediction coefficient determined from the speech signal of the subject subframe). This residual signal obtained by the prediction filter 307 is supplied as teacher data to the normalization equation addition circuit 374.

In the above-described manner, after the teacher data and the student data are obtained, the process proceeds to step S42, wherein the tap generation sections 371 and 372 generate a prediction tap and a class tap for the residual signal on the basis of the L code from the code determination section 215 by using the decoded residual signal supplied from the arithmetic unit 214, respectively. That is, the tap generation sections 371 and 372 generate a prediction tap and a class tap for the residual signal from the decoded residual signal of the subject subframe from the arithmetic unit 214, and the lag-compensating past data and the lag-compensating future data, respectively.

Furthermore, in step S42, the tap generation sections 381 and 382 generate a prediction tap and a class tap for the linear prediction coefficient from the linear prediction coefficient of the subject subframe, supplied from the vector quantization section 205.

Then, the prediction tap for the residual signal is supplied from the tap generation section 371 to the normalization equation addition circuit 374, and the class tap for the residual signal is supplied from the tap generation section 372 to the classification section 373. Furthermore, the prediction tap for the linear prediction coefficient is supplied from the tap generation section 381 to the normalization equation addition circuit 384, and the class tap for the linear prediction coefficient is supplied from the tap generation section 382 to the normalization equation addition circuit 383.

Thereafter, in step S43, the classification sections 373 and 383 perform classification on the basis of the class tap supplied thereto, and supply the resulting class code to the normalization equation addition circuits 384 and 374, respectively.

Then, the process proceeds to step S44, where the normalization equation addition circuit 374 performs the above-described addition of the matrix A and the vector v of equation (13) for each class code from the classification section 373 by using the residual signal of the subject subframe as the teacher data from the prediction filter 370 and the prediction tap as the student data from the tap generation section 371 as objects. Furthermore, in step S44, the normalization equation addition circuit 384 performs the above-described addition of the matrix A and the vector v of equation (13) for each class code from the classification section 383 by using the linear prediction coefficient of the subject subframe as the teacher data from the LPC analysis section 204 and the prediction tap as the student data from the tap generation section 381 as objects, and the process proceeds to step S45.

In step S45, it is determined whether or not there is still a learning speech signal of a frame to be processed as a subject subframe. When it is determined in step S45 that there is still a learning speech signal of a frame to be processed as a subject subframe, the process returns to step S41, where the next subframe is newly assumed to be a subject subframe, and hereafter, the same processes are repeated.

When it is determined in step S45, that there is no learning speech signal of a frame to be processed as a subject subframe, the process proceeds to step S46, where the tap-coefficient determination circuit 375 determines the tap coefficient for the residual signal for each class by solving the normalization equation formulated for each class, and supplies the tap coefficient to the address, corresponding to each class, of the coefficient memory 376, whereby the tap coefficient is stored. Furthermore, the tap-coefficient determination circuit 385 also determines the tap coefficient for the linear prediction coefficient for each class by solving the normalization equation formulated for each class, and supplies the tap coefficient to the address, corresponding to each class, of the coefficient memory 386, whereby the tap coefficient is stored, and the processing is then terminated.

In the above-described manner, the tap coefficient for the residual signal for each class, stored in the coefficient memory 376, is stored in the coefficient memory 344 of FIG. 18, and the tap coefficient for the linear prediction coefficient for each class, stored in the coefficient memory 386, is stored in the coefficient memory 354 of FIG. 18.

Therefore, the tap coefficients stored in the coefficient memories 344 and 354 of FIG. 18 are determined in such a way that the prediction error (square error) of the prediction values of the true residual signal and the true linear prediction coefficient obtained by performing a linear prediction computation, respectively, become statistically a minimum. Consequently, the residual signals and the linear prediction coefficients output from the prediction sections 345 and 355 of FIG. 18 approximately match the true residual signal and the true linear prediction coefficient, respectively. As a result, the synthesized speech generated on the basis of the residual signal and the linear prediction coefficient becomes of high sound quality with a small amount of distortion.

Next, the above-described series of processes can be performed by hardware and can also be performed by software. In a case where the series of processes are to be performed by software, programs which form the software are installed into a general-purpose computer, etc.

Figure 23:
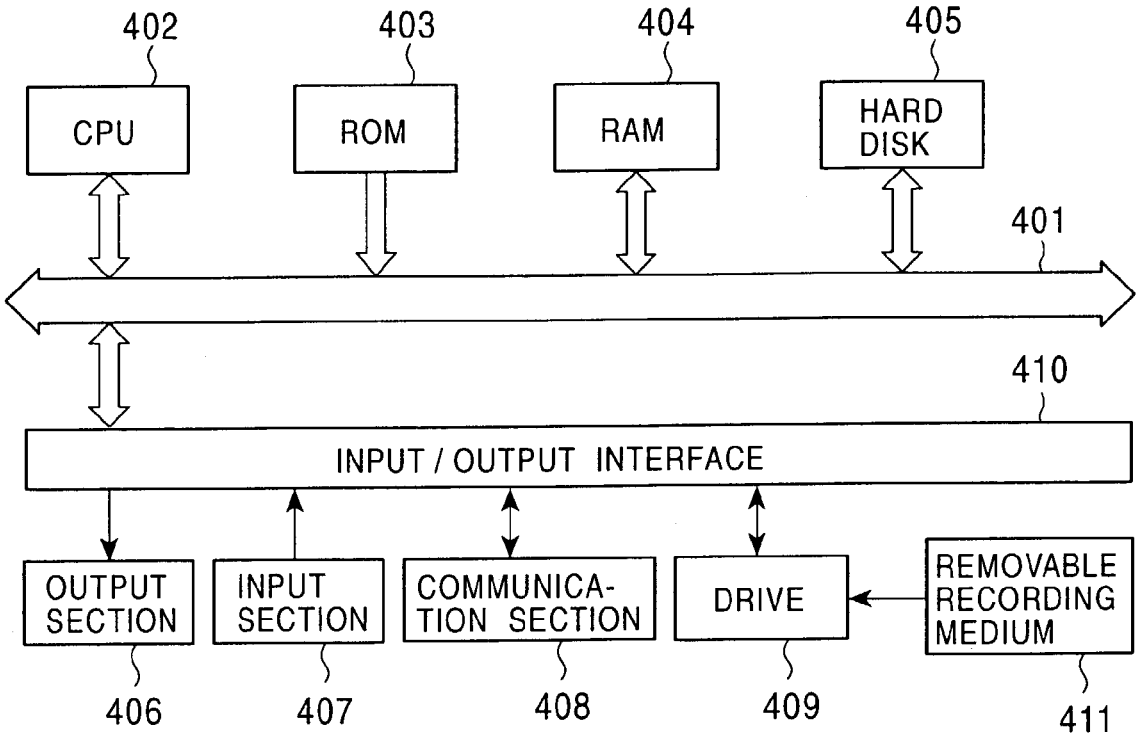
FIG. 23 is a block diagram showing an example of the configuration of an embodiment of a computer according to the present invention.

Therefore, FIG. 23 shows an example of the configuration of an embodiment of a computer into which programs for executing the above-described series of processes are installed.

The programs can be prerecorded in a hard disk 405 and a ROM 403 as a recording medium built into the computer.

Alternatively, the programs may be temporarily or permanently stored (recorded) in a removable recording medium 411, such as a floppy disk, a CD-ROM (Compact Disc Read Only Memory), an MO (Magneto optical) disk, a DVD (Digital Versatile Disc), a magnetic disk, or a semiconductor memory. Such a removable recording medium 411 may be provided as what is commonly called packaged software.

In addition to being installed into a computer from the removable recording medium 411 such as that described above, programs may be transferred in a wireless manner from a download site via an artificial satellite for digital satellite broadcasting or may be transferred by wire to a computer via a network, such as a LAN (Local Area Network) or the Internet, and in the computer, the programs which are transferred in such a manner are received by a communication section 408 and can be installed into the hard disk 405 contained therein.

The computer has a CPU (Central Processing Unit) 402 contained therein. An input/output interface 410 is connected to the CPU 402 via a bus 401. When a command is input as a result of a user operating an input section 407 formed of a keyboard, a mouse, a microphone, etc., via the input/output interface 410, the CPU 402 executes a program stored in the ROM (Read Only Memory) 403 in accordance with the command. Alternatively, the CPU 402 loads a program stored in the hard disk 405, a program which is transferred from a satellite or a network, which is received by the communication section 408, and which is installed into the hard disk 405, or a program which is read from the removable recording medium 111 loaded into a drive 409 and which is installed into the hard disk 405, to a RAM (Random Access Memory) 404, and executes the program. As a result, the CPU 402 performs processing in accordance with the above-described flowcharts or processing performed according to the constructions in the above-described block diagrams. Then, the CPU 402 outputs the processing result, for example, from an output section 406 formed of an LCD (Liquid Crystal Display), a speaker, etc., via the input/output interface 410, as required, or transmits the processing result from the communication section 408, and furthermore, records the processing result in the hard disk 405.

Here, in this specification, processing steps which describe a program for causing a computer to perform various types of processing need not necessarily perform processing in a time series along the described sequence as a flowchart and contain processing performed in parallel or individually (for example, parallel processing or object-oriented processing) as well.

Furthermore, a program may be such that it is processed by one computer or may be such that it is processed in a distributed manner by plural computers. In addition, a program may be such that it is transferred to a remote computer and is executed thereby.

Although in this embodiment, no particular mention is made as to what kinds of learning speech signals are used as learning speech signals, in addition to speech produced by a human being, for example, a musical piece (music), etc., can be employed as learning speech signals. According to the learning apparatus such as that described above, when reproduced human speech is used as a learning speech signal, a tap coefficient such as that which improves the sound quality of human speech is obtained. When a musical piece is used, a tap coefficient such as that which improves the sound quality of the musical piece will be obtained.

Although tap coefficients are stored in advance in the coefficient memory 124, etc., the tap coefficients to be stored in the coefficient memory 124, etc., can be downloaded in the mobile phone 101 from the base station 102 (or the exchange 103) of FIG. 3, a WWW (World Wide Web) server (not shown), etc. That is, as described above, tap coefficients suitable for certain kinds of speech signals, such as for human speech production or for a musical piece, can be obtained through learning. Furthermore, depending on teacher data and student data used for learning, tap coefficients by which a difference occurs in the sound quality of synthesized speech can be obtained. Therefore, such various kinds of tap coefficients can be stored in the base station 102, etc., so that a user is made to download tap coefficients desired by the user. Such a downloading service of tap coefficients can be performed free or for a charge. Furthermore, when downloading service of tap coefficients is performed for a charge, the cost for the downloading the tap coefficients can be charged, for example, together with the charge for telephone calls of the mobile phone 101.

Furthermore, the coefficient memory 124, etc., can be formed by a removable memory card which can be loaded into and removed from the mobile phone 101, etc. In this case, if different memory cards in which various types of tap coefficients, such as those described above, are stored are provided, it becomes possible for the user to load a memory card in which desired tap coefficients are stored into the mobile phone 101 and to use it depending on the situation.

In addition, the present invention can be widely applied to a case in which, for example, synthesized speech is produced from codes obtained as a result of coding by a CELP method such as VSELP (Vector Sum Excited Linear Prediction), PSI-CELP (Pitch Synchronous Innovation CELP), or CS-ACELP (Conjugate Structure Algebraic CELP).

Furthermore, the present invention is not limited to the case where synthesized speech is produced from codes obtained as a result of coding by a CELP method, and can be widely applied to a case in which a residual signal and a linear prediction coefficient are obtained from certain codes in order to produce synthesized speech.

In addition, the present invention is not limited to sound and can also be applied to, for example, images, etc. That is, the present invention can be widely applied to data which is processed by using period information indicating a period, such as an L code.

Furthermore, although in this embodiment, prediction values of high-quality sound, a residual signal, and a linear prediction coefficient are determined by linear first-order prediction computation using tap coefficients, these prediction values can also be determined by high-order prediction computation of a second or higher order.

In addition, although in the embodiment, tap coefficients themselves are stored in the coefficient memory 124, etc., additionally, for example, coefficient seeds, as information which serves as tap coefficient sources (seeds) by which stepless adjustments are possible (variation in an analog fashion are possible), may be stored in the coefficient memory 124, etc., so that tap coefficients from which sound of the quality desired by the user is obtained can be generated from the coefficient seeds.

INDUSTRIAL APPLICABILITY

According to the first data processing apparatus, the first data processing method, the first program, and the first recording medium of the present invention, with respect to subject data of interest within predetermined data, by extracting predetermined data according to period information, a tap used for a predetermined process is generated, and a predetermined process is performed on the subject data by using the tap. Therefore, for example, high-quality decoding of data becomes possible.

According to the second data processing apparatus, the second data processing method, the second program, and the second recording medium of the present invention, predetermined data and period information are generated as student data, which is a student for learning, from teacher data, which is used as a teacher for learning. Then, with respect to the subject data of interest within predetermined data as the student data, by extracting the predetermined data according to the period information, a prediction tap used to predict teacher data is generated, learning is performed so that the prediction error of the prediction value of the teacher data, obtained by performing a predetermined prediction computation by using the prediction tap and the tap coefficient, statistically becomes a minimum, and a tap coefficient is determined. Therefore, for example, it becomes possible to obtain a tap coefficient for obtaining high-quality data.

The invention claimed is:

1. A speech decoding apparatus, comprising:

a decoding unit for decoding input code data into synthesized speech data;

a first tap generation section for generating a class tap on the basis of the synthesized speech data; wherein the first tap generation section generates the class tap for a subject subframe of the synthesized speech data on the basis of a long-term prediction lag code separated from the coded data;

a classification section for generating a class code based on the class tap;

a coefficient memory for providing a tap coefficient corresponding to the class code;

a second tap generation section for generating a prediction tap based on the synthesized speech data; wherein the second tap generation section generates the prediction tap for the subject subframe of the synthesized speech data on the basis of the long-term prediction lag code;

a prediction section for performing a prediction computation based on the prediction tap and the tap coefficient to provide sound data; and a digital-to-analog conversion section for converting and outputting the sound data to a speaker.

2. The speech decoding apparatus according to claim 1, wherein the classification section generates the class code by performing an Adaptive Dynamic Range Coding (ADRC) operation.

3. The speech decoding apparatus according to claim 1, wherein the decoding unit comprises:

a channel decoder for separating a long-term prediction lag code, a gain code, an excitation code, and A-codes from the code data; the long-term prediction lag code, the gain code, and the excitation code being decoded into a residual signal;

a filter coefficient decoder for decoding the A-codes into linear prediction coefficients; and a speech synthesis filter for generating the synthesized speech data from the residual signal using the linear prediction coefficients.

4. The speech decoding apparatus according to claim 1, wherein the prediction computation performed by the prediction section is a sum-of-products computation for a subject subframe of the sound data.

5. A speech decoding method, comprising:

a decoding step of decoding input code data into synthesized speech data;

a first tap generation step of generating a class tap on the basis of the synthesized speech data; wherein the first tap generation step generates the class tap for a subject subframe of the synthesized speech data on the basis of a long-term prediction lag code separated from the coded data;

a classification step of generating a class code based on the class tap;

a coefficient step of providing a tap coefficient corresponding to the class code;

a second tap generation step of generating a prediction tap based on the synthesized speech data; wherein the second tap generation step generates the prediction tap for the subject subframe of the synthesized speech data on the basis of the long-term prediction lag code;

a prediction step of performing a prediction computation based on the prediction tap and the tap coefficient to provide sound data; and a digital-to-analog conversion step of converting and outputting the sound data to a speaker.

6. The speech decoding method according to claim 5, wherein the classification step generates the class code by performing an Adaptive Dynamic Range Coding (ADRC) operation.

7. The speech decoding method according to claim 5, wherein the decoding step comprises:

a channel decoding step of separating a long-term prediction lag code, a gain code, an excitation code, and A-codes from the code data; the long-term prediction lag code, the gain code, and the excitation code being decoded into a residual signal;

a filter coefficient decoding step of decoding the A-codes into linear prediction coefficients; and a speech synthesis filtering step of generating the synthesized speech data from the residual signal using the linear prediction coefficients.

8. The speech decoding method according to claim 5, wherein the prediction computation performed in the prediction step is a sum-of-products computation for a subject subframe of the sound data.

* * * * *

UNITED STATES PATENT AND TRADEMARK OFFICE

CERTIFICATE OF CORRECTION

PATENT NO. : 7,269,559 B2
APPLICATION NO. : 10/239135
DATED : September 11, 2007
INVENTOR(S) : Tetsujiro Kondo et al.

It is certified that error appears in the above-identified patent and that said Letters Patent is hereby corrected as shown below:

On the title page of the patent, item (86), "Mar. 30, 2003", should read --Mar. 3, 2003--.

Signed and Sealed this

First Day of June, 2010

David J. Kappos

David J. Kappos
*Director of the United States Patent and Trademark Office*